US007347064B2

(12) United States Patent
Katoh et al.

(10) Patent No.: US 7,347,064 B2
(45) Date of Patent: Mar. 25, 2008

(54) EVAPORATOR

(75) Inventors: Yoshiki Katoh, Chita-gun (JP); Etsuo Hasegawa, Nagoya (JP); Ken Muto, Toyota (JP); Masaaki Kawakubo, Oobu (JP)

(73) Assignee: DENSO Corporation, Kariya (JP)

( * ) Notice: Subject to any disclaimer, the term of this patent is extended or adjusted under 35 U.S.C. 154(b) by 257 days.

(21) Appl. No.: 11/316,210

(22) Filed: Dec. 22, 2005

(65) Prior Publication Data

US 2006/0185386 A1 Aug. 24, 2006

(30) Foreign Application Priority Data

Dec. 28, 2004 (JP) ..... 2004-379926

(51) Int. Cl.
*F25B 39/02* (2006.01)
*F28D 7/06* (2006.01)

(52) U.S. Cl. ..... 62/515; 165/176

(58) Field of Classification Search ..... 62/500, 62/515; 165/151, 174, 176
See application file for complete search history.

(56) References Cited

U.S. PATENT DOCUMENTS 4,589,265 A * 5/1986 Nozawa ..... 62/526
5,701,760 A * 12/1997 Torigoe et al. ..... 62/524
5,931,020 A * 8/1999 Nakamura ..... 62/527
6,257,322 B1 * 7/2001 Toh et al. ..... 165/104.12
6,449,979 B1 9/2002 Nagasawa et al.
6,516,486 B1 * 2/2003 Mehendale et al. ..... 62/503
6,530,423 B2 * 3/2003 Nakado et al. ..... 165/153
6,536,517 B2 3/2003 Hoshino et al.
6,595,273 B2 * 7/2003 Shimoya ..... 165/152
6,786,277 B2 * 9/2004 Hark et al. ..... 165/178
6,827,139 B2 * 12/2004 Kawakubo et al. ..... 165/173
7,086,249 B2 * 8/2006 Bae et al. ..... 62/504
2004/0206490 A1 10/2004 Katoh et al.
2005/0006073 A1 1/2005 Demuth et al.
2005/0039901 A1 2/2005 Demuth et al.
2005/0103486 A1 5/2005 Demuth et al.

FOREIGN PATENT DOCUMENTS

EP 0 823 609 12/2001
JP 3-170756 A * 7/1991
JP 10-160286 6/1998
JP 2001-074388 3/2001
JP 2002-081795 3/2002
JP 2002-303500 10/2002
JP 2004-003787 1/2004
JP 2005-207716 8/2005
WO WO 03/054465 7/2003
WO WO 03/054466 7/2003
WO WO 03/054467 7/2003

* cited by examiner

*Primary Examiner*—Mohammad M. Ali
(74) *Attorney, Agent, or Firm*—Harness, Dickey & Pierce, PLC

(57) ABSTRACT

An evaporator operated with the carbon dioxide gas, comprises at least a unit core including a plurality of heat transmission tubes having a path with a refrigerant flowing therein, a first tank connected to an end opening of the heat transmission tubes and formed with a refrigerant supply path and a second tank connected to the other end opening of the heat transmission tubes and formed with a refrigerant discharge path. The width L1 of the unit core is given as 50 mm≦L1≦175 mm. The equivalent diameter d of the refrigerant supply path of the first tank and the refrigerant discharge path of the second tank is given as 4.7 mm≦d≦9.6 mm.

41 Claims, 21 Drawing Sheets

EVAPORATOR

TECHNICAL FIELD

This invention relates to an evaporator used in a refrigeration cycle, etc., and operated using a carbon dioxide gas ($CO_2$).

BACKGROUND ART

As a refrigerant for a refrigeration cycle, a CFC substitute refrigerant (R134a) is widely used. In the refrigeration cycle driven by this CFC substitute, an evaporator constituting a kind of an external heat exchanger is arranged downstream of an expansion valve, and a refrigerant, reduced in pressure by the expansion valve, flows into the evaporator. In the evaporator, the refrigerant is evaporated (gasified) by exchanging heat with the air and, after absorbing heat from the surrounding air, changes the air into cool air. The evaporator comprises one or a plurality of rows, arranged along the thickness, each including one or a plurality of unit cores each having a multiplicity of juxtaposed heat transmission tubes in which the refrigerant flows, a first tank connected to one opening of the heat transmission tubes and having a refrigerant supply path or a refrigerant discharge path and a second tank connected to the other opening of the heat transmission tubes and having a refrigerant supply path or a refrigerant discharge path.

In view of the fact that the refrigerant is in a gas-liquid double phase in the first and second tanks, the shape and size (diameter, length) thereof has a great effect on the distribution characteristic of the refrigerant to the heat transmission tubes. In a case, for example, in which the first tank having the refrigerant supply path is connected to the lower end opening of the heat transmission tubes and the second tank having the refrigerant discharge path is connected to the upper end opening, while the refrigerant is moved upward in the heat transmission tubes, the liquid refrigerant and the gas refrigerant are dispersed in the portion near the inlet of the first tank, while the liquid and gas refrigerants begin to be separated from each other at the intermediate portion. At the portion far from the inlet, the liquid refrigerant and the gas refrigerant are separated from each other, and the liquid refrigerant is stored in the first tank by the force of inertia so that CFC (chlorofluorocarbon) refrigerant, containing a large amount of liquid refrigerant, moves upward along the heat transmission tubes.

As described above, the ratio between the liquid refrigerant and the gas refrigerant is varied between the portions near and far from the inlet of the first tank in the transverse direction of the unit core. The liquid refrigerant contributes to the cooling operation, while the gas refrigerant does not substantially contribute to the cooling. Thus, the variation of the cooling temperature (uneven temperature distribution) occurs between the portions near to the inlet and far side from the inlet. The lack of uniformity of the temperature distribution tends to be significant in the time of a low refrigerant flow rate where the gas-liquid separation is promoted.

In the conventional evaporator (Japanese Unexamined Patent Publication No. 2001-074388), in contrast, a throttle is arranged, at a portion far from the refrigerant inlet/outlet in the tank for inflow and outflow of the CFC refrigerant, to control the flow of the liquid refrigerant.

In the prior art, a particular longitudinal portion (range) of the tank where a throttle is arranged cannot be easily determined, and it is difficult to accommodate the transverse size change of the core. Also, the throttle arrangement described above, though effective for the evaporator operated with the CFC refrigerant, is not necessarily effective for a closely-watched evaporator operated with a carbon dioxide gas refrigerant. Specifically, the operating pressure of the carbon dioxide gas refrigerant in the evaporator reaches as high as about ten times that of the CFC refrigerant and, in order to accommodate this high pressure, the tank plate thickness is required to be increased or the pressure-receiving area in the tank is required to be reduced (the tank diameter is required to be reduced). It is still unknown how the throttle in what shape is suitable to be arranged in the tank thick and small in inner diameter.

The throttle arranged blocks the refrigerant flow and generates a pressure loss. Further, a carbon dioxide gas refrigerant, as compared with the CFC refrigerant, has different physical values. The gas-liquid density difference of the carbon dioxide gas, for example, is about 1/80 and considerably different from that of the CFC refrigerant of about 1/8.5. This gas-liquid density difference is related to the gas-liquid separability.

DISCLOSURE OF THE INVENTION

This invention has been achieved in view of the aforementioned situation, and the object of the invention is to provide an evaporator which operates with a carbon dioxide refrigerant and with a reduced tank pressure loss and a high cooling performance.

The present inventor has discovered an optimum equivalent diameter of the refrigerant supply path and the refrigerant discharge path of the tank of the evaporator operated with the carbon dioxide gas. The evaporator according to this invention includes at least one core row having at least one unit core. The unit core is configured of a plurality of heat transmission tubes having a refrigerant up path or a refrigerant down path, a first tank connected to one opening of the heat transmission tubes and a second tank connected to the opening of the heat transmission tubes. The evaporator is divided into the following six types according to the configuration of the heat transmission tubes, and the configuration and the connecting points of the first and second tanks.

(1) First Invention

According to a first invention, there is provided an evaporator including at least one core row arranged along the thickness and having at least one transversely arranged core. Specifically, as in the first aspect of the invention, the evaporator operated with the carbon dioxide gas comprises a unit core including a plurality of heat transmission tubes having a path with a refrigerant flowing therein, a first tank connected to an end opening of the heat transmission tubes and formed with a refrigerant supply path and a second tank connected to an other end opening of the heat transmission tubes and formed with a refrigerant discharge path. The width L1 of the unit core is given as 50 mm$\leqq$L1$\leqq$175 mm. The equivalent diameter d of the refrigerant supply path of the first tank and the refrigerant discharge path of the second tank is given as 4.7 mm$\leqq$d$\leqq$9.6 mm.

(A) First, the refrigerant and the cycle constituting a prerequisite of the invention is explained. The evaporator according to this invention operates using a carbon dioxide gas. Also, the evaporator according to this invention can be used with a refrigeration cycle, an ejector cycle and a heat pump. Specifically, as in the thirty-eighth aspect of the invention, the evaporator is applicable to a refrigeration cycle having an internal heat exchanger or, as in the thirty-ninth aspect of the invention, to an ejector cycle including an ejector. Also, the evaporator, as in the fortieth aspect of the invention, is applicable to a refrigeration cycle or an ejector cycle with an expansion valve or a liquid-gas separator arranged upstream thereof or, as in the forty-first aspect thereof, the invention is applicable to a refrigeration cycle or an ejector cycle with a liquid-gas separator arranged downstream thereof.

The refrigeration cycle has a compressor, a condenser, an expansion valve and an evaporator, and may further include an internal heat exchanger for exchanging internal heat between, for example, the inlet of the compressor, i.e. the outlet of the evaporator and the outlet of the condenser. The ejector in the ejector cycle reduces the pressure of the carbon dioxide refrigerant flowing out from the expansion valve and recovers the expansion energy. In the refrigeration cycle and the ejector cycle, a gas-liquid separator for separating the liquid refrigerant and the gas refrigerant from each other may be arranged upstream or downstream of the evaporator. The heat pump can perform the cooling or heating operation in a single refrigeration cycle. The indoor evaporator absorbs heat from the internal air by evaporating the refrigerant in cooling mode and generates heat by condensing the refrigerant in heating mode. This concept of the refrigerant and each of the various cycles is applicable similarly to the second to sixth inventions described below.

(B) Next, the equivalent diameter of the evaporator and the tank according to the invention is explained. The evaporator includes at least one unit core having a multiplicity of heat transmission tubes, a first tank and a second tank. The multiplicity of the heat transmission tubes (heat transmission tube group), though desirably arranged vertically, may alternatively be arranged in other directions. The first and second tanks may be connected to the upper or lower end opening of the heat transmission tubes. The first tank includes a refrigerant supply path, and the second tank includes a refrigerant discharge path. Specifically, according to this invention, the tank having a refrigerant supply path is called "the first tank", and the tank having a refrigerant discharge path "the second tank" regardless of which end of the heat transmission tubes it is connected to.

The "equivalent diameter" is a concept corresponding to each of the refrigerant supply path and the refrigerant discharge path and defined as a diameter of the cross sectional area converted to a path having a circular cross section regardless of the shape or number of the refrigerant supply paths and the refrigerant discharge paths. For an equivalent diameter of 6 mm, for example, the cross sectional area of the refrigerant supply path is about 28.3 $mm^2$. The equivalent diameter of the refrigerant supply path and that of the refrigerant discharge path may or may not be equal to each other. In the case where the forward end of the heat transmission tubes is projected into the refrigerant supply path and the refrigerant discharge path, the area occupied by the projection is not included in the calculation. The area of the projection is also excluded in the calculation of the cross sectional area of the portion (non-inserted part) between adjacent tubes. The concept of the evaporator and the equivalent diameter is applicable similarly to the second to sixth inventions described below.

(2) Second Invention

The evaporator according to the second invention includes a plurality of comparatively narrow unit cores arranged transversely in at least one row. Specifically, as in the second aspect of the invention, the evaporator operated using carbon dioxide gas comprises a core row including a plurality of transversely arranged unit cores each having a plurality of heat transmission tubes formed with a path in which the refrigerant flows, a first tank connected to one end opening of the heat transmission tubes and formed with a refrigerant supply path and a second tank connected to the other end opening of the heat transmission tubes and formed with a refrigerant discharge path. The width L1 of each unit core is given as 50 mm≦L1≦175 mm. Also, the equivalent diameter d of the refrigerant supply path of the first tank and the refrigerant discharge path of the second tank of each unit core is given as 4.7 mm≦d≦9.6 mm.

Two or more unit cores are arranged transversely, and at least one core row is included. The equivalent diameter d of the first unit core and the second unit core may or may not be the same in the range of 4.7 mm to 9.6 mm. In the case where the core row includes two unit cores as in the third aspect of the invention, the heat transmission tubes of the first unit core on one transverse side can have a refrigerant up path or a refrigerant down path, and the heat transmission tubes of the second unit core on the other transverse side can have a refrigerant down path or a refrigerant up path. In this case, the refrigerant flows in opposite directions in the first unit core and the second unit core, and therefore the first tank of the first unit core and the first tank of the second unit core are located at opposite ends along the height of the heat transmission tubes.

In the lower end portion of the heat transmission tubes, for example, one half portion near to an end of a tube member comparatively small in diameter having one path may make up the second tank of the first unit core, and the other half portion near to the other end thereof may make up the first tank of the second unit core. In the upper end portion, on the other hand, one half portion near to an end of a tube member may make up the first tank of the first unit core, and the other half portion near to the other end thereof may make up the second tank of the second unit core, with a partition (separator) arranged at the intermediate portion. In this case, the refrigerant flows from the second tank of the first unit core into the first tank of the second unit core along a path in the shape of a U or an inverted U through the first and second unit cores.

Also, as in the fourth aspect of the invention, the heat transmission tubes of both the first unit core on one transverse side and the second unit core on the other transverse side may have a refrigerant up path or a refrigerant down path. In this case, the refrigerant flows in the same direction in the first unit core and the second unit core. Therefore, the first tank of the first unit core and the first tank of the second unit core are located at the same end (the upper end, for example) along the height of the heat transmission tubes. At the lower end along the height of the unit core, for example, one half portion near to one end of a tube member may constitute the first tank of the first unit core, and the other half portion near to the other end thereof may make up the first tank of the second unit core.

In the case where each core row includes three unit cores as in the fifth aspect of the invention, the heat transmission tubes of the first unit core on one transverse side and the third unit core on the other transverse side can have a refrigerant up path or a refrigerant down path, and the heat transmission tubes of the second unit core can have a refrigerant down path or a refrigerant up path. In this case, the refrigerant flows from the second tank of the first unit core to the first tank of the second unit core on the one hand and from the second tank of the second unit core to the first tank of the third unit core on the other hand. Consequently, the refrigerant flows along a path in the shape of an S or an inverted S from the first unit core to the third core. For example, the second tank of the first unit core may be formed at one end, the first tank of the second unit core at the intermediate portion and the second tank of the third unit core at the other end of a tube member, with a separator mounted between the intermediate portion and the other end.

In the case where each core row includes four unit cores as in the sixth aspect of the invention, the heat transmission tubes of both the first unit core and the third unit core on one transverse side can have a refrigerant up path or a refrigerant down path, and the heat transmission tubes of both the second unit core and the fourth unit core on the other transverse side can have a refrigerant down path or a refrigerant up path. In this case, the refrigerant flows along a path in the shape of a W or an inverted W from the first unit core to the fourth unit core.

As described above, in the evaporator including a plurality of unit cores in juxtaposition, the equivalent diameter of the paths of the tank having a refrigerant inlet to the evaporator and the tank having a refrigerant outlet from the evaporator is especially important.

(3) Third Invention

The evaporator according to the third invention includes an arrangement of a plurality of core rows. Specifically, as in the seventh aspect of the invention, the evaporator operated with the carbon dioxide gas comprises a plurality of core rows, juxtaposed along the thickness, each having at least one transversely arranged unit core including a plurality of heat transmission tubes formed with a path in which the refrigerant flows, a first tank connected to one end opening of the heat transmission tubes and formed with a refrigerant supply path and a second tank connected to the other end opening of the heat transmission tubes and formed with a refrigerant discharge path. The width L1 of the unit core of each core row is given as 50 mm≦L1≦175 mm. Also, the equivalent diameter d of the refrigerant supply path of the first tank and the refrigerant discharge path of the second tank of the unit core of each core row is given as 4.7 mm≦d≦9.6 mm.

Each core row may include at least one unit core. The number of the unit cores, i.e. the length of the core row, though desirably the same, may be different. In the case where two core rows are arranged as in the eighth aspect of the invention, the first core row and the second core row are arranged in opposed relation to each other in the direction of air flow. The refrigerant may flow in the same or different directions in the first core row and the second core row. In the case where three core rows are included as in the ninth aspect of the invention, the first, the second and the third core rows are arranged in opposed relation to each other along the direction of air flow. The refrigerant may flow in the same direction in all of the first, second and third core rows, or partly in the same direction and partly in opposite directions.

As in the tenth aspect of the invention, the equivalent diameter d of the refrigerant supply path of the first tank and the refrigerant discharge path of the second tank of each core row can be set in the range of 4.9 mm≦d≦9.6 mm. By the way, the lower limit value 4.9 mm is the result of considering the pressure loss in the tubes and the tanks for two or more core rows.

In the case where two core rows are included and each core row includes two unit cores, the heat transmission tubes of the first unit core on one transverse side of the first core row can have a refrigerant up path or a refrigerant down path, and the heat transmission tubes of the second unit core on the other transverse side of the second core row can have a refrigerant down path or the refrigerant up path. As in the eleventh aspect of the invention, the heat transmission tubes of the first unit core on one transverse side of the second core row can have a refrigerant down path or a refrigerant up path, and the heat transmission tubes of the second unit core on the other transverse side of the second core row can have a refrigerant up path or a refrigerant down path. Specifically, the refrigerant flows in opposite directions through the first unit core and the second unit core of the first core row, through the first unit core and the second unit core of the second core row, through the first unit core of the second core row and the second unit core of the first core row, and through the second unit core of the first core row and the second core of the second core row, respectively.

In this case, at the upper end of the heat transmission tubes, the second tank of the first unit core of the first core row is formed at an end of the first path of the tube member comparatively large in diameter having two paths, and at the other end, the first tank of the second unit core is formed. Also, the first tank of the first unit core of the second core row is formed at an end of the second path, and the other tank of the second unit core at the other end. At the lower end of the unit core, on the other hand, the first tank of the first unit core of the first core row is formed at one end of the first path of the tube member comparatively large in diameter having two paths, while the second tank of the second unit core is formed at the other end. Also, the second tank of the first unit core of the second core row is formed at one end of the second path, and the first tank of the second unit core at the other end. As in the eleventh aspect of the invention, the width L2 of the first and second core rows is given as 100 mm≦L2≦350 mm.

As in the twelfth aspect of the invention, the equivalent diameter d of the refrigerant supply path and the refrigerant discharge path can be given as 5.6 mm≦d≦9.6 mm, and the width L2 of the first and the second core rows is given as 200 mm≦L2≦350 mm. The lower limit value 5.6 mm is the result of considering the pressure loss and the cooling performance in the case where a plurality of core rows are included and each core row includes a plurality of unit cores.

In the case where each core row includes three unit cores and three core rows are included, the heat transmission tubes of one of the first, second and third unit cores of the first core row can have a refrigerant up path or a refrigerant down path, and the heat transmission tubes of the remaining two cores can have a refrigerant down path or a refrigerant up path. For example, the S-shaped pattern according to the fifth aspect described above can be employed. The heat transmission tubes of one of the first, second and third unit cores of the second core row can have a refrigerant down path or a refrigerant up path, and the heat transmission tubes of the remaining two unit cores can have a refrigerant up path or a refrigerant down path. For example, the inverted S-shaped pattern according to the fifth aspect described above can be employed.

As in the thirteenth aspect of the invention, the width L2 of the first and second core rows can be given as 150 mm≦L2≦525 mm. As in the fourteenth aspect of the invention, the width L2 of the first and second core rows can be given as 50 mm×(number of unit cores)≦L2≦175 mm×(number of unit cores).

In the case where two core rows are included and each core row includes two or more unit cores, all the heat transmission tubes of the two or more unit cores of the first core row can be a refrigerant up path or a refrigerant down path, and all the heat transmission tubes of the two or more unit cores of the second core row can have a refrigerant down path or a refrigerant up path.

In the case where two core rows are included and each has two or more unit cores as in the fifteenth aspect of the invention, the second tank of the first unit core on one axial side of the first core row can be connected to the first tank of the second unit core on the other axial side of the second core row, and the second tank of the second unit core on the other axial side of the first core row can be connected to the first tank of the first unit core on one axial side of the second core row in the shape of X. All the heat transmission tubes of the two or more unit cores of the first core row can have a refrigerant up path or a refrigerant down path, and all the heat transmission tubes of the two or more unit cores of the second core row can have a refrigerant down path or a refrigerant up path.

Also, in the case where two core rows are included and each includes two or more unit cores as in the sixteenth aspect of the invention, the first unit core of the first core row can be connected with the first unit core of the second core row, and the second unit core of the first core row can be connected with the second unit core of the second core row. All the heat transmission tubes of the two or more unit cores of the first core row can have a refrigerant up path or a refrigerant down path, and all the heat transmission tubes of the two or more unit cores of the second core row can have a refrigerant down path or a refrigerant up path.

As in the seventeenth aspect of the invention, the first and second unit cores of the first core row can be connected with the first and second unit cores of the second core row. As in the eighteenth aspect of the invention, the equivalent diameter d of the refrigerant supply path and the refrigerant discharge path can be given as 4.7 mm≦d≦8.0 mm.

(4) Fourth Invention

The fourth invention relates, in an evaporator, to the equivalent diameter or especially the upper limit value of the equivalent diameter of the refrigerant supply path and the refrigerant discharge path of the unit core having a down path in the case where a plurality of core rows are included. Specifically, as in the nineteenth aspect of the invention, an evaporator operated using carbon dioxide gas comprises a plurality of juxtaposed core rows, arranged along the thickness, each including at least one transversely arranged unit core having a plurality of heat transmission tubes formed with a path in which the refrigerant flows, a first tank connected to one end opening of the heat transmission tubes and formed with a refrigerant supply path and a second tank connected to the other end opening of the heat transmission tubes and formed with a refrigerant discharge path.

The width L1 of the unit core of each core row is given as 50 mm≦L1≦175 mm. Also, the equivalent diameter d of the refrigerant supply path of the first tank of the unit core including the heat transmission tubes formed with the refrigerant down path and the refrigerant discharge path of the second tank is given as 4.7 mm≦d≦10.6 mm. The upper limit value of 10.6 mm is set taking into consideration the fact that the unit has a down path.

In the case where two core rows are included as in the twentieth aspect of the invention, the first and second core rows can be arranged in opposed relation to each other along the direction of air flow. As in the twenty-first aspect of the invention, the equivalent diameter d of the refrigerant supply path of the first tank of the unit core of each core row and the refrigerant discharge path of the second tank are given as 4.9 mm≦d≦9.6 mm.

In the case where two core rows are included and each core row has two or more unit cores as in the twenty-second aspect of the invention, the heat transmission tubes of the first unit core on one transverse side of the first core row can have a refrigerant up path or a refrigerant down path, and the heat transmission tubes of the second unit core on the other transverse side can have a refrigerant down path or a refrigerant up path. The refrigerant moves in opposite vertical directions in the first and second unit cores. The heat transmission tubes of the first unit core on one transverse side of the second core row can have a refrigerant up path or a refrigerant down path, and the heat transmission tubes of the second unit core on the other transverse side can have a refrigerant down path or a refrigerant up path. The width L2 of the first and second core rows is given as 100 mm≦L2≦350 mm.

In the case where two core rows are included and each core row has three unit cores as in the twenty-third aspect of the invention, the heat transmission tubes of one of the first, second and third unit cores of the upstream-side first core row can have a refrigerant up path or a refrigerant down path, and the heat transmission tubes of the remaining two unit cores can have a refrigerant down path or a refrigerant up path. The heat transmission tubes of one of the first, second and third unit cores of the downstream-side second core row can have a refrigerant down path or a refrigerant up path, and the heat transmission tubes of the remaining two unit cores can have a refrigerant up path or a refrigerant down path. The width L2 of the first and second core rows is given as 150 mm≦L2≦425 mm.

In the case where each core row (each of the first and second core rows, for example) includes two or more unit cores as in the twenty-fourth aspect of the invention, all the heat transmission tubes of the two or more unit cores of the first core row can have a refrigerant up path or a refrigerant down path, and the heat transmission tubes of two or more unit cores of the second core row can have a refrigerant down path or a refrigerant up path. The width L2 of the first and second core rows can be given as 50×(number of unit cores)≦L2≦175 mm×(number of unit cores).

As in the twenty-fifth aspect of the invention, the equivalent diameter d of the refrigerant supply path and the refrigerant discharge path can be given as 4.7 mm≦d ≦8.0 mm. The upper limit value of 8.0 mm is the result of considering a case in which the tolerable variation of temperature distribution is small (5° C.). As in the twenty-sixth aspect of the invention, the equivalent diameter d of the refrigerant supply path and the refrigerant discharge path can be given as 5.6 mm≦d ≦9.6 mm, and the width L2 of the first and second core rows can be given as 200 mm ×≦L2≦350 mm.

As described above, in an evaporator having a plurality of core rows in juxtaposition, the equivalent diameter of the paths of the tank having a refrigerant inlet to the evaporator and the tank having a refrigerant outlet from the evaporator has an especially important meaning.

(5) Fifth Invention

In the evaporator according to the fifth invention, the first and second unit cores of the first core row and the first and second unit cores of the second core row are connected to each other in X form at an end along the height (at the upper end, for example) of the unit cores. Specifically, as in the twenty-seventh aspect of the invention, the evaporator operated using carbon dioxide gas comprises at least two core rows juxtaposed along the thickness each including at least two transversely arranged unit cores each having a plurality of heat transmission tubes formed with a path in which the refrigerant flows, a first tank connected to one end opening of the heat transmission tubes and formed with a refrigerant supply path for supplying the refrigerant to the heat transmission tubes and a second tank connected to the other end opening of the heat transmission tubes and formed with a refrigerant discharge path for discharging the refrigerant from the heat transmission tubes.

The refrigerant discharged from the refrigerant discharge path of the second tank of the first unit core of the first core row is supplied to the refrigerant supply path of the first tank of the second unit core of the second core row in opposed relation to the second unit core of the first core row. The refrigerant discharged from the refrigerant discharge path of the second tank of the second unit core of the first core row is supplied to the refrigerant supply path of the first tank of the first unit core of the second core row in opposed relation to the first unit core of the first core row.

The width L1 of each unit core of each core row is given as 50 mm≦L1≦175 mm. Also, the equivalent diameter d of the refrigerant supply path of the first tank and the refrigerant discharge path of the second tank of each unit core of each row is given as 4.7 mm≦d≦9.6 mm. The refrigerant flows in the same direction through the first and second unit cores of the first core row, and in the same direction (the direction opposite to the flow in the first core row) through the first and second unit cores of the second core row.

As in the twenty-eighth aspect of the invention, the equivalent diameter d of the refrigerant supply path and the refrigerant discharge path can be given as 4.7 mm≦d≦8.0 mm. As in the twenty-ninth aspect of the invention, the equivalent diameter d of the refrigerant supply path of the first tank and the refrigerant discharge path of the second tank can be given as 5.6 mm≦d≦9.6 mm. The width L2 of the firs and second core rows is given as 200 mm≦L2≦350 mm.

(6) Sixth Invention

The evaporator according to the sixth invention, as compared with the first invention, has a larger width of the unit core. Specifically, as in the thirtieth aspect of the invention, the evaporator operated using carbon dioxide gas comprises at least on core row, arranged along the thickness, each including at least one transversely arranged unit core having a plurality of heat transmission tubes formed with a path in which the refrigerant flows, a first tank connected to one end opening of the heat transmission tubes and formed with a refrigerant supply path for supplying the refrigerant to the heat transmission tubes and a second tank connected to the other end opening of the heat transmission tubes and formed with a refrigerant discharge path for discharging the refrigerant from the heat transmission tubes.

All the heat transmission tubes of each core row have a refrigerant up path or a refrigerant down path, and the width L2 of each core row is given as 100 mm≦L2≦350 mm. Also, the equivalent diameter d of the refrigerant supply path of the first tank and the refrigerant discharge path of the second tank is given as 4.9 mm≦d≦10.6 mm.

In the case where two core rows are included and each includes at least one unit core as in the thirty-first aspect of the invention, the evaporator may comprise an upstream-side first core row including one unit core with the heat transmission tubes having one up path and a downstream-side second core row including one unit core in opposed relation to the unit core of the first core row along the thickness with the heat transmission tubes having a refrigerant down path. As in the thirty-second aspect of the invention, a distribution control plate for adjusting the refrigerant distribution can be arranged in the refrigerant supply path of the first tank. The unit core in which the refrigerant flows has a large width, and therefore the first and second tanks are correspondingly long.

(7) Related Matters

According to the first to sixth inventions, as in the thirty-third aspect, the equivalent diameter Dp of each heat transmission tube of the unit core of each core row can be given as 0.55 mm≦Dp≦1.0 mm. As in the thirty-fourth aspect of the invention, the height H of each core row can be set as 100 mm≦H≦235 mm. As in the thirty-fifth aspect, the refrigerant supply path and the refrigerant discharge path each can be configured of a plurality of paths. As in the thirty-sixth aspect, the heat transmission tubes of the unit core of the first core row can be integrally formed with the heat transmission tubes of the unit core of the second core row. As in the thirty-seventh aspect, a fin is interposed between the adjacent heat transmission tubes of the unit core, and a groove extending along the height can be formed on the surface of the heat transmission tubes in contact with the fin.

Next, the effects of the invention are explained.

(1) With the evaporator according to the first invention, a satisfactory refrigerant distribution characteristic, i.e. a satisfactory temperature distribution characteristic, is obtained in each transverse area of the unit core regardless of the magnitude of refrigerant dryness in the case where one core row is included and the core row has one unit core.

(2) With the evaporator according to the second invention, a satisfactory refrigerant distribution characteristic, i.e. a satisfactory temperature distribution characteristic is obtained in each area of each unit core regardless of the magnitude of refrigerant dryness in the case where one core row includes a multiplicity of unit cores. In the evaporator according to the third aspect, a satisfactory temperature distribution is obtained in each unit core in the case where two unit cores are included and the refrigerant flows in opposite directions through the two unit cores. In the evaporator according to the fourth aspect, a satisfactory temperature distribution is obtained for each unit core in the case where two unit cores are included and the refrigerant flows in the same direction through the two unit cores. In the evaporator according to the fifth aspect, a satisfactory temperature distribution is obtained for each unit core in the case where three unit cores are included and the refrigerant flows along a path in the shape of an S or an inverted S. In the evaporator according to the sixth aspect, a satisfactory temperature distribution is obtained for each unit core in the case where four unit cores are included and the refrigerant flows along a path in the shape of a W or an inverted W.

(3) With the evaporator according to the third invention, a satisfactory refrigerant distribution characteristic, i.e. a satisfactory temperature distribution characteristic is obtained for each area of each unit core of each core row regardless of the magnitude of refrigerant dryness degree in the case where two or more core rows are included. In the evaporator according to the eighth aspect, a satisfactory refrigerant distribution characteristic, i.e. a satisfactory temperature distribution characteristic is obtained for each unit core of each core row in the case where two or more core rows are included. In the evaporator according to the ninth aspect, a satisfactory refrigerant distribution characteristic, i.e. a satisfactory temperature distribution characteristic is obtained for each unit core of each core row in the case where three or more core rows are included.

In the evaporator according to the tenth aspect, the lower limit value of the equivalent diameter is increased, and therefore a satisfactory refrigerant distribution characteristic is obtained while suppressing the pressure loss in the tank. In the evaporator according to the eleventh aspect, a satisfactory refrigerant distribution characteristic, i.e. a satisfactory temperature distribution characteristic is obtained in the case where two core rows each include two unit cores and the refrigerant flows in opposite directions through the two unit cores. In the evaporator according to the twelfth aspect, the lower limit value of the equivalent diameter is increased, and therefore a satisfactory refrigerant distribution characteristic is obtained while suppressing the pressure loss of the tank. In the evaporator according to the thirteenth aspect, a satisfactory refrigerant distribution characteristic, i.e. a satisfactory temperature distribution characteristic is obtained in the case where two core rows are included according to the fifth aspect and the refrigerant flows along a path in the shape of S in each core row.

In the evaporator according to the fourteenth and sixteenth aspects, a satisfactory refrigerant distribution characteristic, i.e. a satisfactory temperature distribution characteristic is obtained in the unit cores in the case where the refrigerant flows in opposite directions through the two unit cores of each row and the unit cores opposed to each other along the thickness of the first or second tank are connected to each other. In the evaporator according to the fourteenth and fifteenth aspects, a satisfactory refrigerant distribution characteristic, i.e. a satisfactory temperature distribution characteristic, is obtained in the case where the refrigerant flows in the same direction through the two unit cores of each row and the unit cores are connected to each other in the shape of X with the first or second tank. In the evaporator according to the eighteenth aspect, the upper limit value of the equivalent diameter is set to 8.0 mm and the variation of the temperature distribution is further reduced.

(4) With the evaporator according to the fourth invention, the upper limit value of the equivalent diameter of the refrigerant supply path of the first tank connected to the heat transmission tubes formed with a refrigerant down path and the refrigerant discharge path of the second tank in the case where a plurality of core rows are included and each core row includes at least one unit core. As a result, a satisfactory refrigerant distribution characteristic, i.e. a satisfactory temperature distribution characteristic is obtained for the unit core of each core row regardless of the dryness degree of the refrigerant. In the evaporator according to the twentieth aspect, a satisfactory refrigerant distribution characteristic, i.e. a satisfactory temperature distribution characteristic is obtained for the unit core of each core row in the case where two or more core rows are included.

In the evaporator according to the twenty-first aspect, the lower limit value of the equivalent diameter is increased, and therefore a satisfactory refrigerant distribution characteristic is obtained while suppressing the pressure loss in the tanks. In the evaporator according to the twenty-third aspect, a satisfactory refrigerant distribution characteristic, i.e. a satisfactory temperature distribution characteristic is obtained for each unit core in the case where two core rows are included in the fifth aspect and the refrigerant flows in each core row along a path in the shape of S. In the evaporator according to the twenty-fourth aspect, a satisfactory refrigerant distribution characteristic, i.e. a satisfactory temperature distribution characteristic is obtained in the case where the refrigerant flows in the same direction in the two unit cores of each core row and the unit cores are connected in the form of X in the first or second tank. In the evaporator according to the twenty-fifth aspect, the upper limit value of the equivalent diameter is set to 8.0 mm and therefore the variation of temperature distribution can be further reduced. In the evaporator according to the twenty-sixth aspect, the lower limit value of the equivalent diameter is increased, and therefore a satisfactory refrigerant distribution characteristic is obtained while suppressing the pressure loss in the tanks.

(1) With the evaporator according to the fifth invention, the unit core on one transverse side of the first core row is connected with the unit core on the other transverse side of the second core row and the unit core on the other transverse side of the first core row is connected with the unit core on one transverse side of the second core row. Therefore, the cooling capacity is balanced between the one axial side and the other axial side of each core row. In the evaporator according to the twenty-eighth aspect, the upper limit value of the equivalent diameter is set to 8.0 mm and, therefore, the variation in temperature distribution can be further reduced. In the evaporator according to the twenty-ninth aspect, the lower limit value of the equivalent diameter is increased and therefore a satisfactory refrigerant distribution characteristic is obtained while suppressing the pressure loss in the tanks.

(1) With the evaporator according to the sixth invention, the variation in temperature distribution can be reduced even in the case where the transverse size of the unit core of the core row is large and the particular unit core has a refrigerant up path or a refrigerant down path. In the evaporator according to the thirty-first aspect, the variation in temperature distribution can be reduced for each unit core in the case where the upstream-side core row has a refrigerant up path and the downstream-side core row has a refrigerant down path.

In the evaporator according to the thirty-second aspect, the gas-liquid separation of the refrigerant can be prevented in the supply path of the first tank connected to the unit core having a refrigerant down path. In the evaporator according to the thirty-third aspect, the pressure loss in the heat transmission tubes can be prevented and suppressed. In the evaporator according to the thirty-fourth aspect, a sufficiently and necessarily high temperature can be secured while suppressing the variation in temperature distribution of the unit core.

Incidentally, the reference numerals in the parentheses indicating each means described above denote correspondence with the specific means described in the embodiments explained later.

The present invention can be understood more fully from the accompanying drawings and the description of the preferred embodiments of the invention made below.

BEST MODE FOR CARRYING OUT THE INVENTION

The best mode for carrying out the invention is explained below with reference to the accompanying drawings.

<First Best Mode>

(Configuration)

Figure 1:
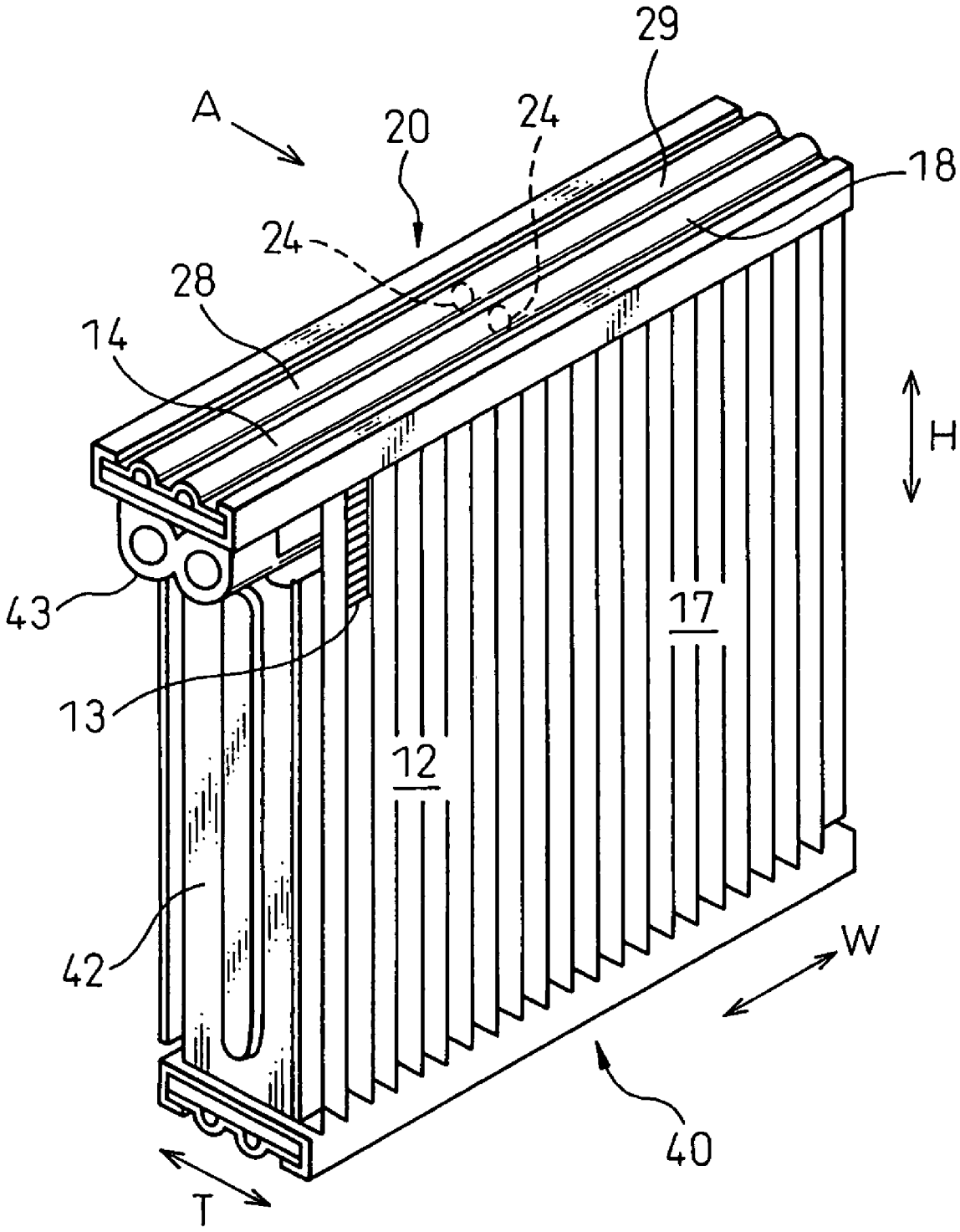
FIG. 1 is a perspective view showing the first best mode for carrying out the invention.
Figure 2:
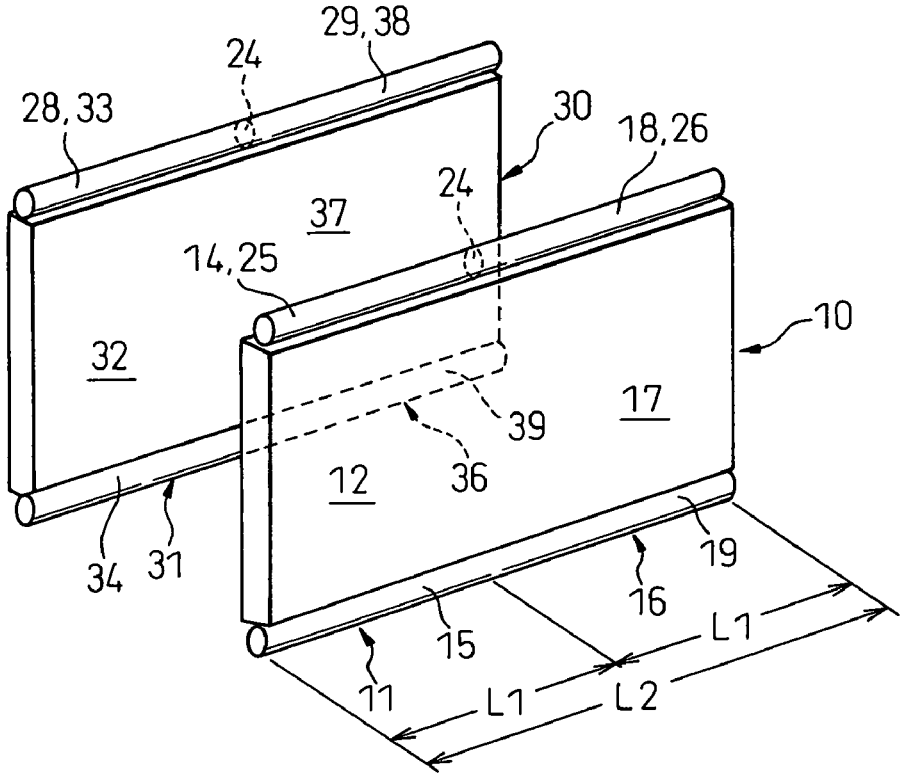
FIG. 2 is a schematic diagram showing the first best mode.

The evaporator according to the first best mode shown in FIGS. 1 and 2 has two core rows each including two unit cores. The air flows in the direction of arrow A. A first core row 10 is arranged downstream in the air flow, and a second core row 30 upstream in the air flow. Both the first and second core rows have a basically symmetric structure in the direction T along the thickness of the evaporator. The downstream-side core row 10 includes a left unit core (first unit core) 11 and a right unit core (second unit core) 16, both of which have a basically symmetric structure along the width W of the evaporator.

The left unit core 11 of the downstream-side core row 10 having a generally thin parallelopipedal shape includes a left tube group 12 having a multiplicity of tubes, an upper left tank portion 14 connected to the upper end of the left tube group 12, and a lower left tank portion 15 connected to the lower end of the left tube group 12. The right unit core 16 includes a right tube group 17 having a multiplicity of tubes, an upper right tank portion 18 connected to the upper end of the right tube group 17, and a lower right tank portion 19 connected to the lower end of the right tube group 17. The tank portion 15 and the tank portion 19 form the left and right halves, respectively, of the downstream portion of the lower tank 40.

The tubes 12 of the left unit core 11 and the tubes 17 of the right unit core 16 are each flat and extend vertically long with open upper and lower ends. A fin 13 is interposed between the adjacent tubes 12, 17. The tank portion 14 of the left unit core 11 and the tank portion 18 of the right unit core 16 form the left and right halves, respectively, of the downstream portion of the upper tank 20 in the air flow. The width L1 of the left unit core 11 and the right unit core 16 is 150 mm, and the height thereof is 200 mm, with the result that the width L2 of the downstream-side core row 10 is 300 mm and the height thereof is 200 mm.

The upstream-side core row 30 includes a left unit core 31 on the left transverse side and a right unit core 36 on the right transverse side. The left unit core 31 includes a left tube group 32, an upper left tank 33 connected to the upper end of the left tube group 32 and a lower right tank 34 connected to the lower end of the left tube group 32. The right unit core 36 includes a right tube group 37, an upper right tank 38 connected to the upper end of the right tube group 37 and a lower right tank 39 connected to the lower end of the right tube group 37. The left unit core 31 and the right unit core 36 have the width L1 of 150 mm and the height of 200 mm, with the result that the downstream-side core row 30 has the width L2 of 300 mm and the height of 200 mm.

Figure 3:
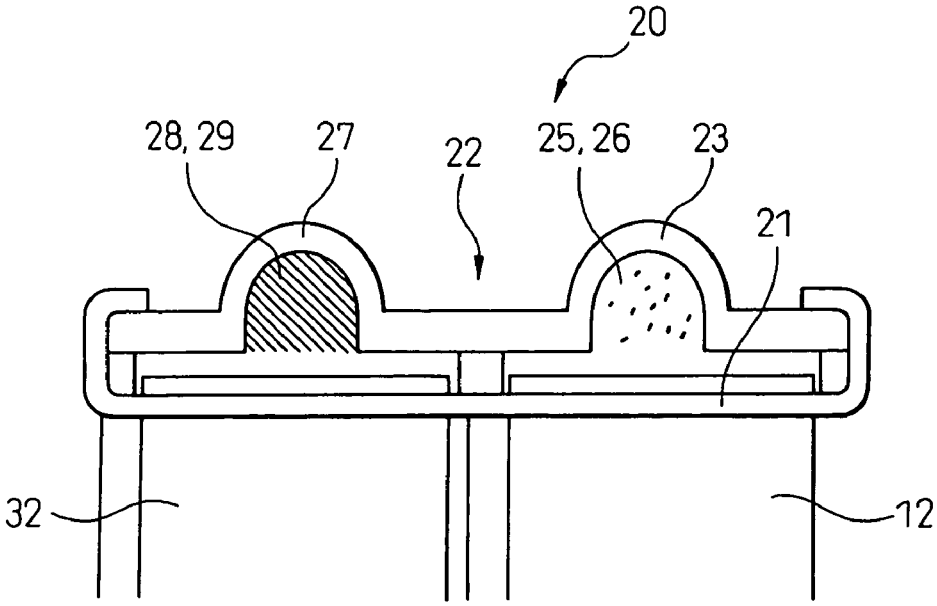
FIG. 3 is a sectional view of an upper tank according to the first best mode.
Figure 4:
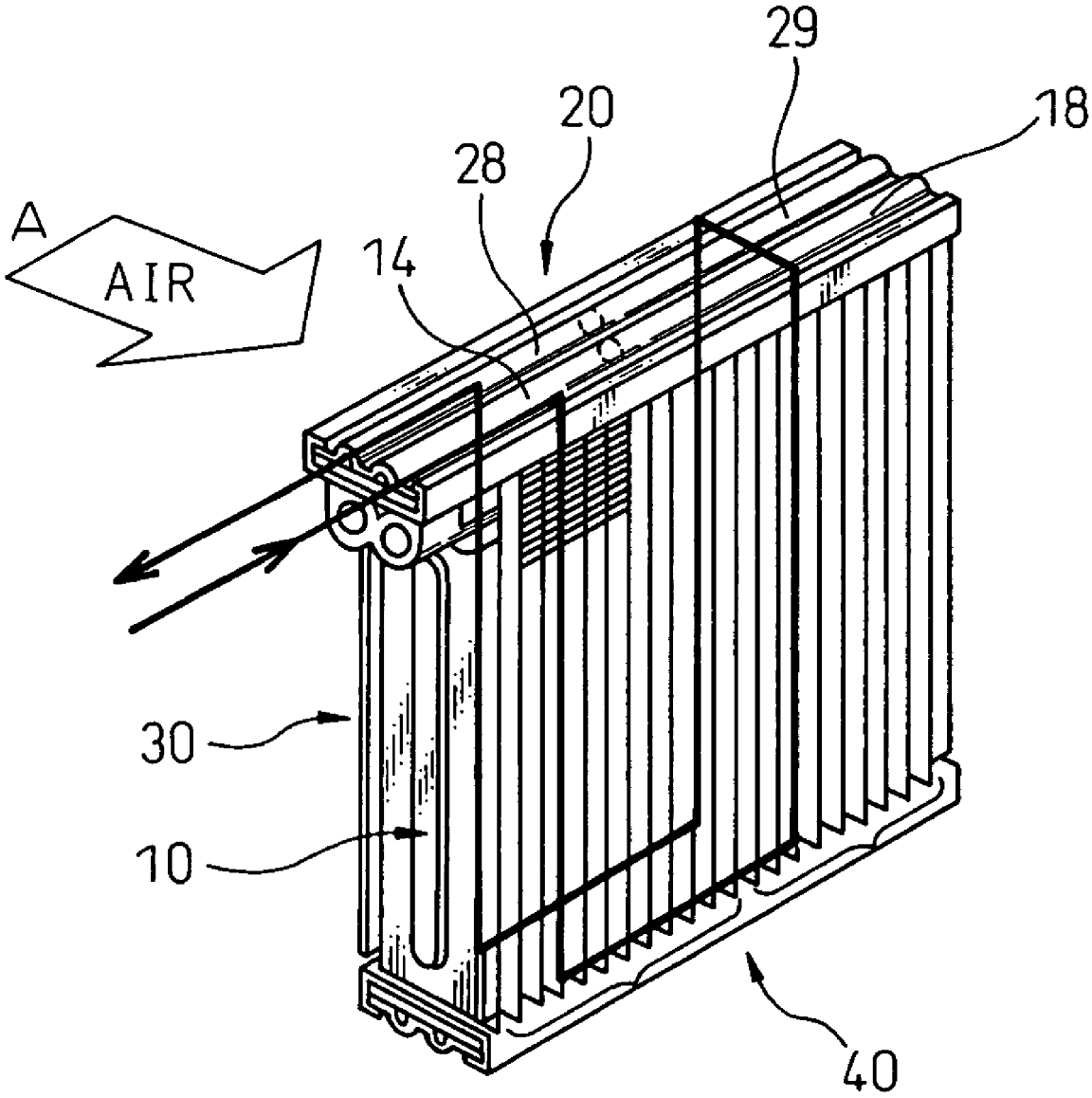
FIG. 4 is a diagram for explaining the operation of the first best mode.

Next, with reference to FIG. 3, the upper tank 20 is explained in detail. As shown in FIG. 3, the upper tank 20 includes a flat bottom plate 21 and a ceiling plate 22 having two semicircular protrusions 23, 27, coupled to each other on the side edges thereof. The linearly extending one (right side in FIG. 3) protrusion 23 having a semicircular cross section forms the upper left tank portion 14 of the left unit core 11 and the upper right tank portion 18 of the right unit core 16 of the downstream-side core row 10. As shown in FIG. 4, a separator 24 is mounted between the tank portions 14, 18, and defines a supply path 25 and a discharge path 26. The linearly extending other (left side in FIG. 3) protrusion 27 having a semicircular cross section is defined into a discharge path 28 and a supply path 29 by a separator 24 mounted between an upper left tank portion 33 of the left unit core 31 of the upstream-side core row 30 and an upper right tank portion 38 of the right unit core 36.

The upper end of the tube group 12 of the left unit core 11 of the downstream-side core row 10 is connected to the supply path 25 defined by the protrusion 23, and the upper end of the tube group 17 of the right unit core 16 is connected to the discharge path 26 defined by the protrusion 23. In similar fashion, the upper end of the tube group 32 of the left unit core 31 of the upstream-side core row 30 is connected to the discharge path 28, and the upper end of the tube group 37 of the right unit core 36 is connected to the supply path 29. The cross section of the supply paths 25, 29 and the discharge paths 26, 28 is about 28.3 $mm^2$, with the result that the equivalent diameter is 6 mm for all of them. The calculation of the equivalent diameter does not include the upper ends of the tube groups 12, 32 projected toward the supply paths 25, 29 and the discharge paths 26, 28.

The lower tank 40 connected to the lower end of the downstream-side core row 10 and the upstream-side core row 30 is configured substantially symmetrically with respect to the upper tank 20 along the height H of the evaporator. Nevertheless, the separator is not arranged at the longitudinal intermediate portion thereof. Side plates 42 are mounted on the two transverse sides of the core rows 10, 30, and a connector 43 is mounted on the lower surface at an end of the upper tank 20.

(Determination of Equivalent Diameter of First Tank)

The process of determining the equivalent diameter of the supply paths 25, 29 and the discharge paths 26, 28 of the upper tank 20 and the supply paths and the discharge paths of the lower tank 40 is explained below. In determination, the variation in temperature distribution, the cooling performance of the evaporator and the pressure loss of the evaporator in the upstream-side core row 10 and the downstream-side core row 30 are taken into consideration.

a. Variation in Temperature Distribution

Figure 5A:
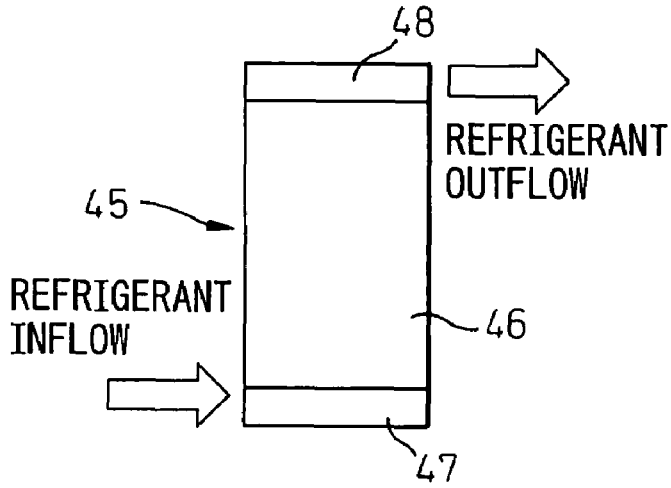
FIG. 5A is a diagram for explaining a test evaporator used to determine the equivalent diameter of the first tank, and FIGS. 5B to 5D diagrams for explaining the manner in which the refrigerant flows with the equivalent diameter changed.
Figure 5B:
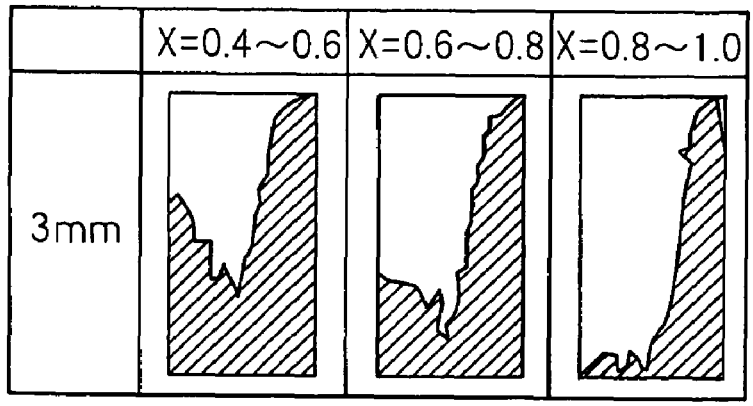
Figure 5C:
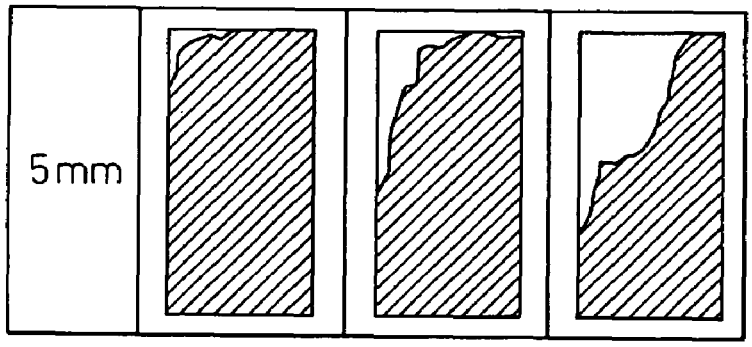
Figure 5D:
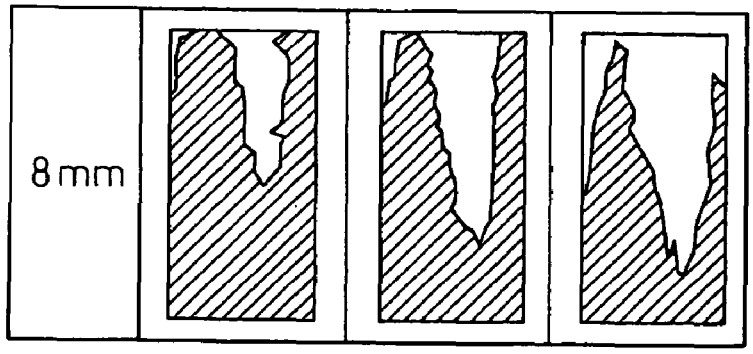

With regard to the variation in temperature distribution, as shown in FIG. 5A, a test evaporator (only one row) 45 including a multiplicity of tubes (tube group) 46, a lower tank 47 at the lower end thereof and an upper tank 48 at the upper end thereof is prepared. This corresponds to the right unit core 16 having the width of 150 mm and the height of 200 mm. The tube group 46 makes up an up path, and the lower tank 47 and the upper and 48 are each formed of a single cylindrical tube member. The lower tank 47 forms a supply path, and the upper tank 48 a discharge path. As shown in FIGS. 5B to 5D, the equivalent diameter d of the lower tank 47 and the upper tank 48 is changed from 3 mm to 5 mm to 8 mm, while the dryness degree X of the refrigerant is changed from 0.4 to 0.6, 0.6 to 0.8 and 0.8 to 1.0.

The refrigerant flowing in from the lower tank 47 rises in the tube group 46 and then flows out of the upper tank 48. The refrigerant is set in such conditions that the pressure is 9.5 MPa at the outlet of the expansion valve, i.e. the inlet of the evaporator 45 and 3.75 MPa at the outlet, and the flow rate is 50 kg/h. The air (wind), on the other hand, is 27° C. in temperature and 50% RH in humidity.

The manner in which the refrigerant flows in the tube group 46 was observed by thermograph. In the hatched areas, the refrigerant is dried out and the surface temperature is 2 to 3° C., while in the areas not hatched, the refrigerant is not dried out and the surface temperature is about 15° C. As can be understood from this, in the case where the equivalent diameter of the lower tank 47 and the upper tank 48 is 3 mm and the dryness degree is 0.4 to 0.6, for example, the temperature of the lower half of the portion near to the inlet is low, the temperature of the lowest one third of the intermediate portion is low, and the temperature of the whole portion far from the inlet, i.e. the portion near to the outlet is low.

In the case where the dryness degree is 0.6 to 0.8, the tendency for the dryness degree of 0.4 to 0.6 increases slightly, and the temperature in the low-temperature range in the portion far from the inlet remains the same as for the dryness degree of 0.4 to 0.6, while the temperature of the low-temperature range in the portion near to the intermediate portion and the inlet is lower than that for the dryness degree 0.4 to 0.6. This tendency further increases for the dryness degree of 0.8 to 1.0, so that the temperature of the low-temperature range in the portion far from the inlet, the intermediate portion and the portion near to the inlet is reduced more than for the dryness degree of 0.6 to 0.8.

In the case where the equivalent diameter is 8 mm, on the other hand, the temperature is low over the whole range including the portion near to the inlet and the portion far from the inlet for the dryness degree of 0.4 to 0.6, while the low-temperature range in the intermediate portion is about one half as small. In the case where the dryness degree is 0.6 to 0.8 and 0.8 to 1.0, on the other hand, the tendency for the dryness degree of 0.4 to 0.6 is further enhanced.

In the case where the equivalent diameter is 5 mm and the dryness degree is 0.4 to 0.6, in contrast, the temperature is low at the portion near to the inlet of the lower tank 47, the intermediate portion and the portion far from the inlet, i.e. the portion near to the outlet. In the case where the dryness degree is 0.6 to 0.8, on the other hand, though the low-temperature range is slightly reduced at the portion near to the inlet, the temperature is generally low at the intermediate portion and the portion far from the inlet. In the case where the dryness degree is 0.8 to 1.0, the low-temperature range is reduced by one half at the portion near to the inlet and the intermediate portion, while the temperature is low in the portion far from the inlet.

From the result described above, it can be understood that, regardless of the magnitude of the dryness degree, the refrigerant flow variation in the tube group 46 is small in the case where the equivalent diameter of the lower tank 47 and the upper tank 46 is 5 mm or a value near thereto. The reason is probably as follows. Specifically, the refrigerant in the lower tank 47 is basically a gas-liquid two-phase flow, and is distributed among the tubes 46 by the following mechanism. At the portion near to the inlet (left end) of the lower tank 47, the refrigerant flow sharply changes, and therefore the gas refrigerant and the liquid refrigerant flow into the tube group 46 in diffused form. The larger the diffusion amount, the higher the refrigerant flow velocity.

With the advance of the liquid refrigerant toward the longitudinal intermediate portion of the lower tank 47, the liquid refrigerant is liable to move downward due to the gravitational force, and the liquid refrigerant and the gas refrigerant begin to be separated, with the result that the liquid refrigerant flowing into the tube group 46 is reduced in amount. In the case where the equivalent diameter of the lower tank 47 is 5 mm, the aforementioned tendency is suppressed at all of the portion near to the inlet, the intermediate portion and the portion far from the inlet. In the case where the refrigerant is high in velocity, however, the gas and liquid are separated from each other to a lesser degree due to the effect of diffusion occurring in the portion near to the inlet. In the portion far from the inlet of the lower tank 47, on the other hand, the liquid refrigerant separated from the gas stays (is pooled) under the force of inertia, and the amount of the liquid refrigerant flowing into the tube group 46 is comparatively increased.

Figure 6A:
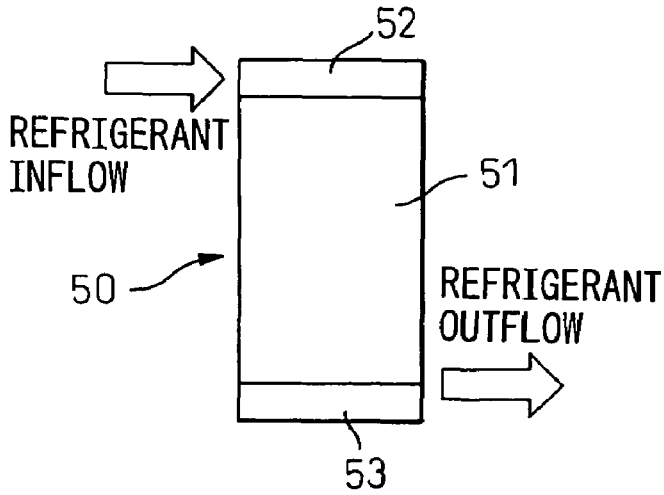
FIG. 6A is a diagram for explaining another test evaporator, and FIGS. 6B to 6D diagrams for explaining the manner in which the refrigerant flows for different equivalent diameters of the tanks.
Figure 6B:
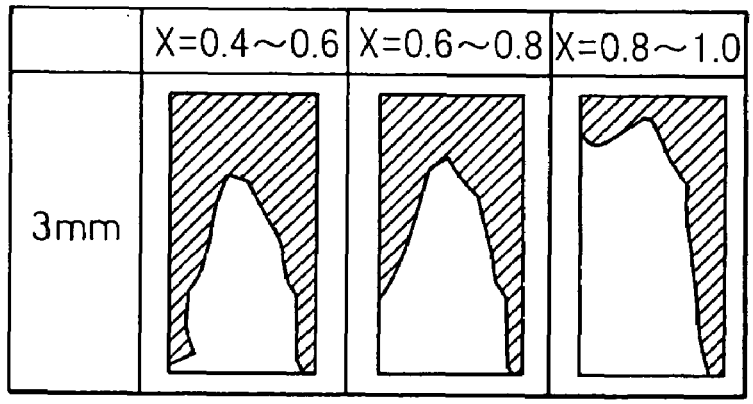
Figure 6C:
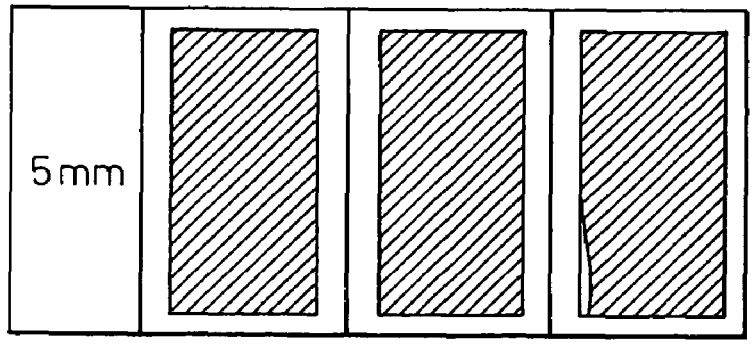

In the case where the refrigerant is introduced into the tube group 51 from the upper tank 52 of the evaporator 50 and flows out from the lower tank 53 as shown in FIG. 6A, on the other hand, the gas-liquid separation is promoted by the gravitational force and, therefore, the liquid refrigerant easily flows into the tube group 51. More specifically, as shown in FIG. 6C, in the case where the equivalent diameter of the upper tank 52 and the lower tank 53 is 5 mm, the temperature is low in all of the portion far from the outlet, the intermediate portion and the portion near to the outlet regardless of the magnitude of the dryness degree.

Figure 6D:
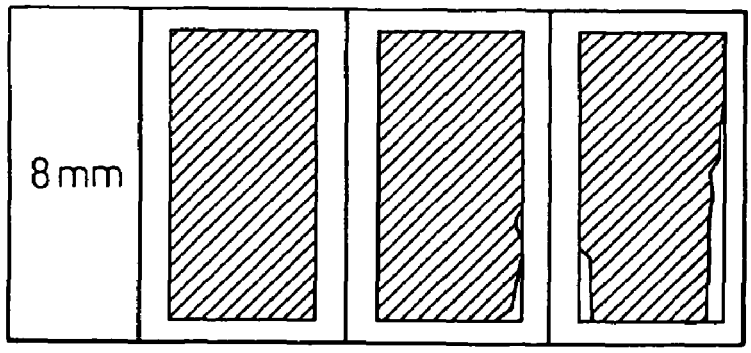

In the case where the equivalent diameter is 8 mm as shown in FIG. 6D, the low-temperature range substantially covers the whole of the portion far from the outlet, the intermediate portion and the portion near to the outlet. In the case where the equivalent diameter is 3 mm as shown in FIG. 6B, in contrast, the high-temperature range tends to widen in the intermediate portion, and this tendency increases with the increase in dryness degree.

From the result described above, it can be understood that, regardless of the magnitude of dryness degree, the variation of the refrigerant in the tube group 51 is small in the case where the equivalent diameter of the upper tank 52 and the lower tank 53 is 5 mm or near to 5 mm. For both the lower tank 42 shown in FIG. 5A and the upper tank 52 shown in FIG. 6A, the greater the length, the easier the gas-liquid separation and, therefore, the greater the tendency of the distribution characteristic to be deteriorated.

b. Determination of Equivalent Diameter

The variation of the temperature of each area of the tube group 46 from the average temperature was studied using the test evaporator 45 shown in FIGS. 5A to 5D. Specifically, the tube group 46 is divided into eight portions including four equal transverse portions and two equal portions along the height, the average temperature for each area is calculated, and the difference between the highest one and the lowest one of the eight average temperatures is determined. In the process, the dryness degree of each of the refrigerants flowing up through the refrigerant up path and the refrigerant flowing down through the refrigerant down path is changed in the three ways mentioned above.

Figure 7:
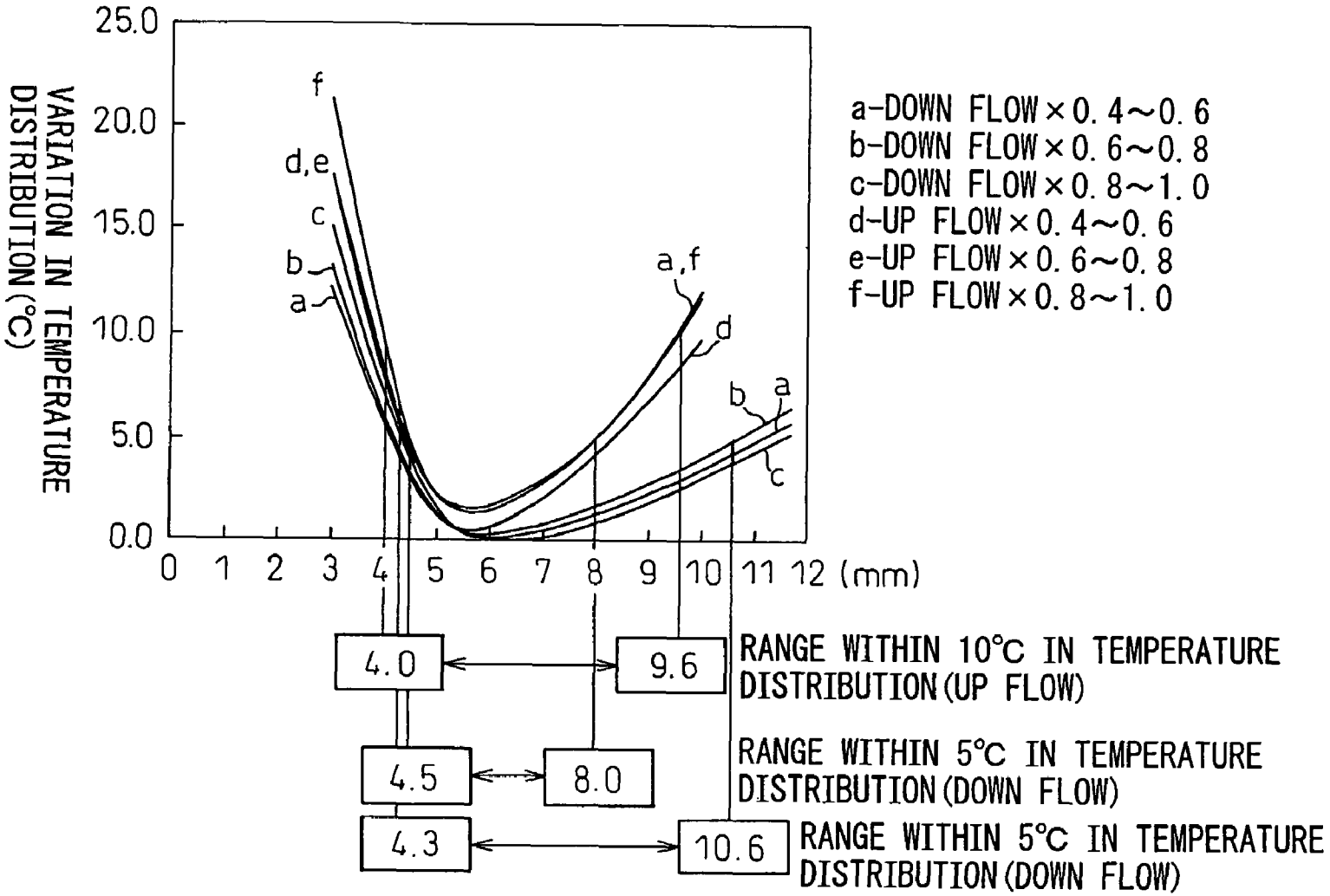
FIG. 7 is a graph showing the relation between the variation in temperature distribution and the equivalent diameter.

The result is shown in FIG. 7, in which the curve a indicates a case where the dryness degree X of the down flow is 0.4 to 0.6, the curve b a case in which the dryness degree X of the down flow is 0.6 to 0.8 and the curve c a case where the dryness degree X of the down flow is 0.8 to 1.0. Also, the curve d indicates a case in which the dryness degree X of the up flow is 0.4 to 0.6, the curve e a case in which the dryness degree X of the up flow is 0.6 to 0.8, and the curve f a case in which the dryness degree of the up flow is 0.8 to 1.0. It is understood that, in general, the variation in temperature distribution increases for a large or a small equivalent diameter of the lower tank 42 and the upper tank 43, while the variation in temperature distribution is small for the intermediate value of the equivalent diameter.

The equivalent diameter associated with 10° C. in the maximum difference of the variation in temperature distribution determined utilizing the curve e for the dryness degree X of 0.6 to 0.8 in the up flow was between 4.0 mm and 9.6 mm inclusive. Also, the equivalent diameter associated with 5° C. of the variation in temperature distribution determined utilizing the curve e was between 4.5 mm and 8.0 mm inclusive. Further, the equivalent diameter associated with 5° C. of the variation in temperature distribution determined utilizing the curve b for the dryness degree of 0.6 to 0.8 in the down flow was between 4.3 mm and 10.6 mm inclusive.

c. Consideration of Cooling Performance And Pressure Loss

Generally, the performance (including the system performance) of the evaporator can be effectively improved by reducing the pressure loss of the tanks and/or tubes of the evaporator. In the case of the CFC refrigerant, the effect of the pressure loss of the evaporator only on the unit performance is required to be considered. In the case of the carbon dioxide gas, however, the pressure on the high-pressure side (radiator) is higher than 10 MPa and the temperature at the outlet of the radiator is higher than 100° C., and the following effect results.

Figure 8A:
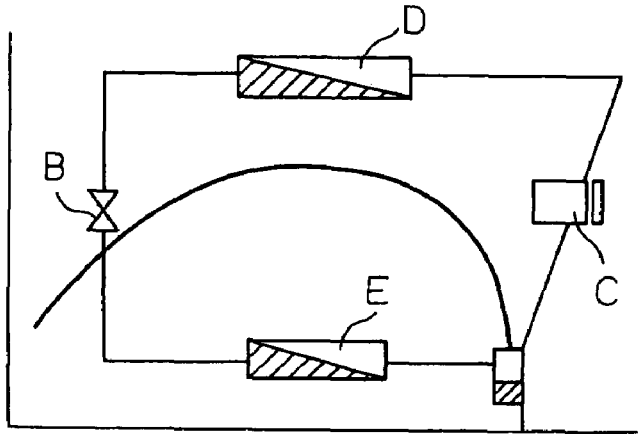
FIG. 8A is a Mollier chart showing the ideal condition, FIG. 8B a Mollier chart with a small pressure loss in the evaporator, and FIG. 8C a Mollier chart with a large pressure loss in the evaporator.
Figure 8B:
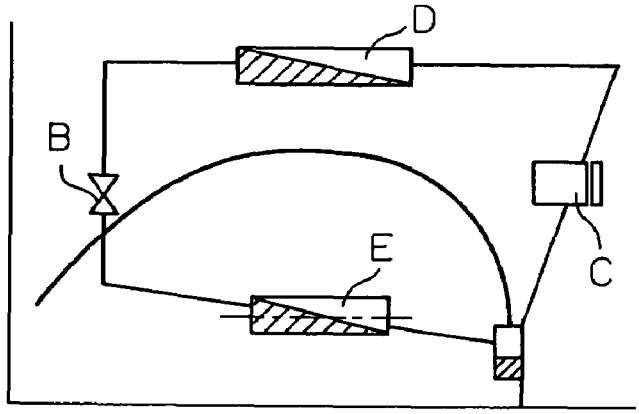

A Mollier diagram of the ideal refrigeration cycle including the compressor C, the radiator D on high pressure side, the expansion valve B and the evaporator E on low pressure side is shown in FIG. 8A. In the case where the pressure loss of the refrigerant is large in the evaporator E, on the other hand, the refrigerant pressure is increased at the inlet of the evaporator E and decreased at the outlet thereof as shown in FIG. 8B, resulting in an increased average evaporation temperature as indicated by the one-dot chain. In mid summer when the load is high, for example, the refrigerant on high pressure side (radiator D) unavoidably increases in both pressure and temperature, and with the increase in the average evaporation temperature of the evaporator E, the system runs short of performance.

Figure 8C:
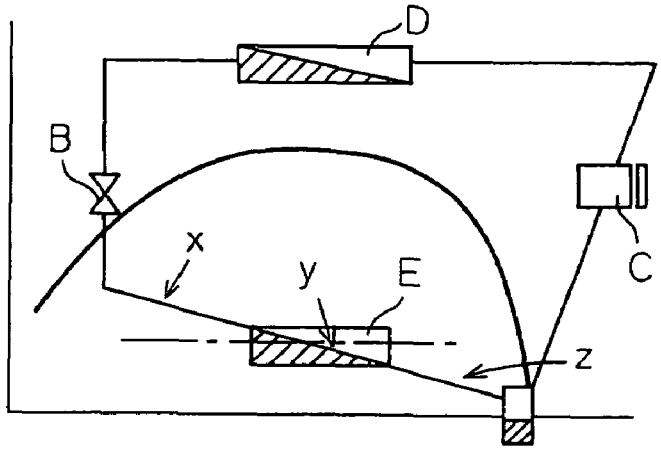

To meet this situation, the rotational speed of the compressor C is increased to supply a larger amount of refrigerant to the refrigeration cycle, so that the low pressure side is further decreased in pressure. Then, the pressure loss is further increased, and both the pressure and temperature at the outlet of the evaporator E are decreased. The outlet temperature of the compressor C is plotted in an isoentropic curve, and therefore, as shown in FIG. 8C, the temperature of the compressor C and the radiator D increases unavoidably with the decrease in the pressure and temperature at the outlet of the evaporator E.

As a result, the compressor may run fail to have enough strength. Specifically, it is known that with the increase in temperature of aluminum constituting the material of the cycle parts such as the compressor C and the radiator D, the strength thereof decreases gradually and then sharply at about 80 to 120° C. An increased thickness of the compressor C to prevent the strength shortage would increase the cost and weight. The capacity may also be required to be increased for the compressor C. Thus, to establish the cycle, it is important to reduce the refrigerant pressure loss of the evaporator E in the refrigeration cycle using the carbon dioxide gas refrigerant.

d. Cooling Performance

On the assumption that the temperature distribution of the tube group 46 of the test evaporator 45 shown in FIG. 5 is constant (free of variation), the cooling performance thereof was studied. This "cooling performance" is a value calculated by multiplying the weight of air capacity by the enthalpy difference determined by the difference between the condition (temperature, humidity) of the air flowing into the tubes 46 and the condition (temperature, humidity) of the air flowing out of the evaporator while changing the equivalent diameter of the lower tank 47 and the upper tank 48. With the change in the equivalent diameter of the lower tank 47 and the upper tank 48, i.e. the cross sectional area (sectional area of the path) thereof, the pressure loss of the refrigerant changes and so does the evaporation temperature of the refrigerant. In other words, the larger the pressure loss, the higher the evaporation temperature, and vice versa. In this way, the cooling performance is changed.

Figure 9A:
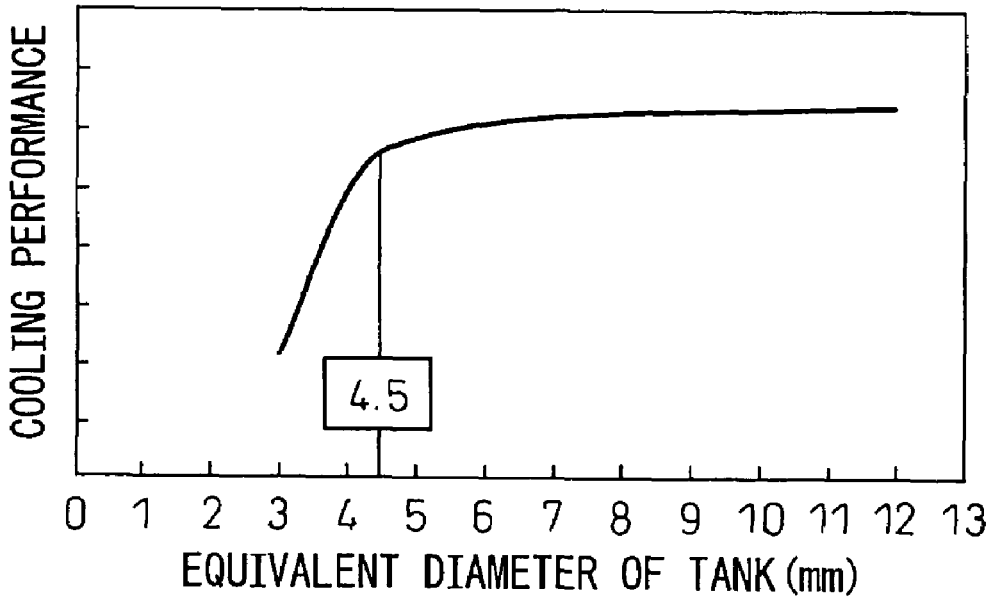
FIG. 9A is a graph showing the cooling performance of the core row including one unit core, and FIG. 9B a graph showing the pressure loss of the refrigerant.

FIG. 9A shows the relation between the equivalent diameter of the lower tank 47 and the upper tank 48 and the cooling performance of the tube group 46. As can be understood from this diagram, the cooling performance is gradually increased for between 3 mm and 4.5 mm in the equivalent diameter of the lower tank 47 and the upper tank 48, and not substantially increased for larger than 4.5 mm. This indicates that the equivalent diameter for a single unit core is desirably at least 4.5 mm to improve the cooling performance.

e. Pressure Loss

Figure 9B:
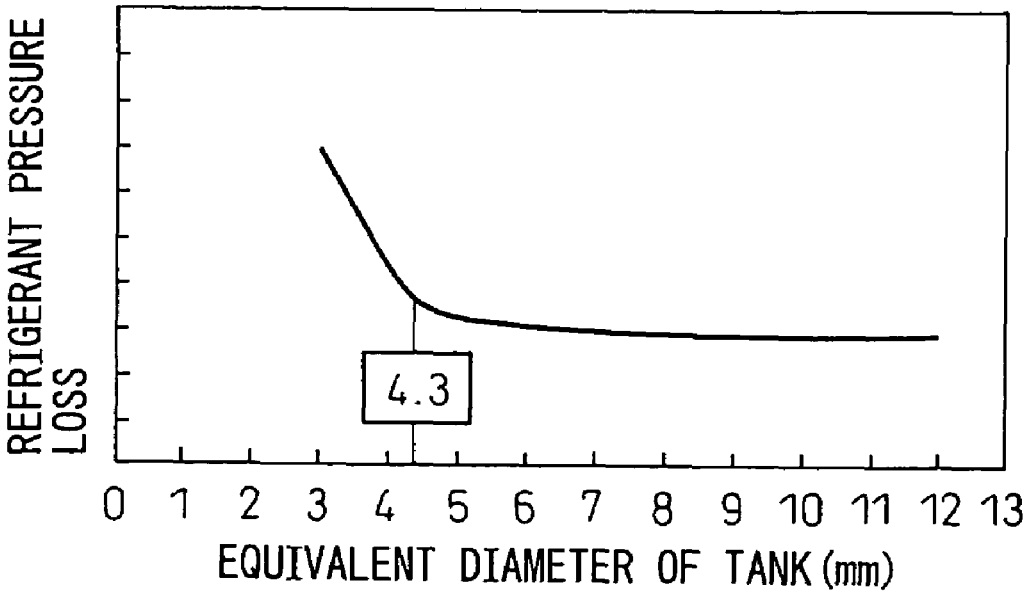

FIG. 9B shows the relation between the equivalent diameter of the lower tank 47 and the outlet tank 48 and the pressure loss of the refrigerant in the test evaporator 45. The "pressure loss" is defined as the difference between the refrigerant pressure at the inlet of the lower tank 47 and the refrigerant pressure at the outlet of the outlet tank 48. As seen from FIG. 9B, the refrigerant pressure loss in the test evaporator 45 is gradually decreased from 0.7 MPa to 0.3 MPa for between 3 mm and 4.3 mm in the equivalent diameter d of the lower tank 47 and the outlet tank 48, and substantially remains unchanged at 0.3 MPa for the equivalent diameter of more than 4.3 mm. This indicates that the equivalent diameter for a single unit core is desirably at least 4.3 mm to suppress the pressure loss.

Figure 10A:
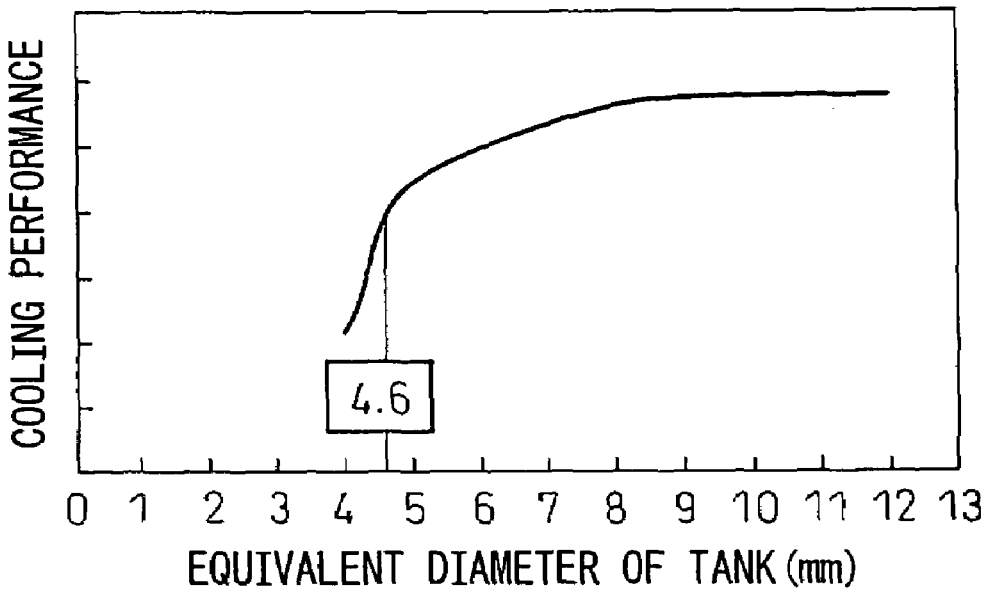
FIG. 10A is a graph showing the cooling performance of the core row including two unit cores, and FIG. 10B a graph showing the pressure loss of the refrigerant.
Figure 10B:
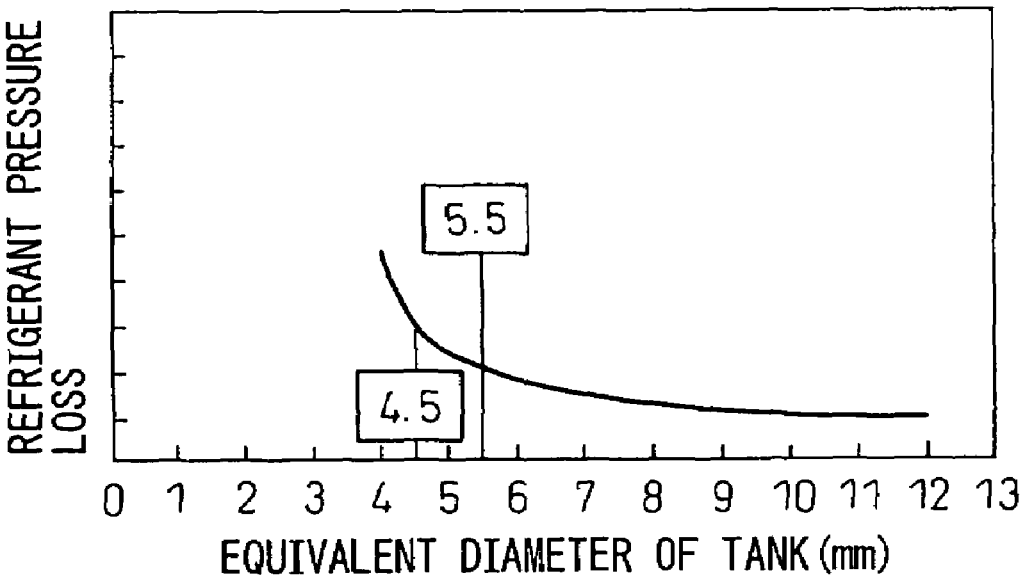

The result of studying the cooling performance and the pressure loss using a test evaporator having two unit cores is shown in FIGS. 10A, 10B. As can be understood, the equivalent diameter is 4.6 mm to obtain the desired cooling performance, and the equivalent diameter is 4.5 mm for the pressure loss of 0.3 MPa and 5.5 mm for the pressure loss of 0.2 MPa. In any case, the equivalent diameter is increased slightly more than for a single unit core.

Figure 11A:
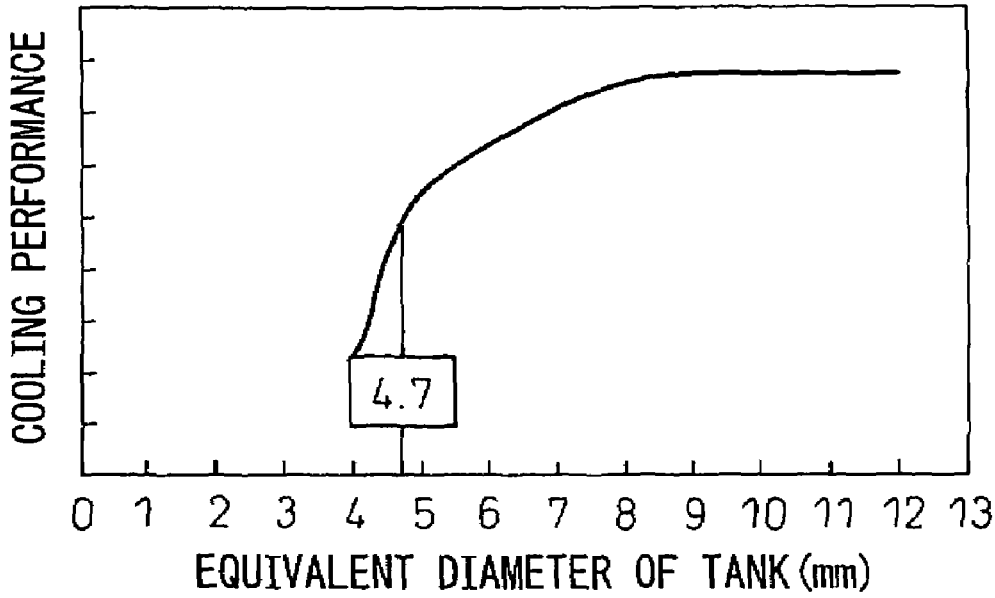
FIG. 11A is a graph showing the cooling performance of the core row including three unit cores, and FIG. 11B a graph showing the pressure loss of the refrigerant.
Figure 11B:
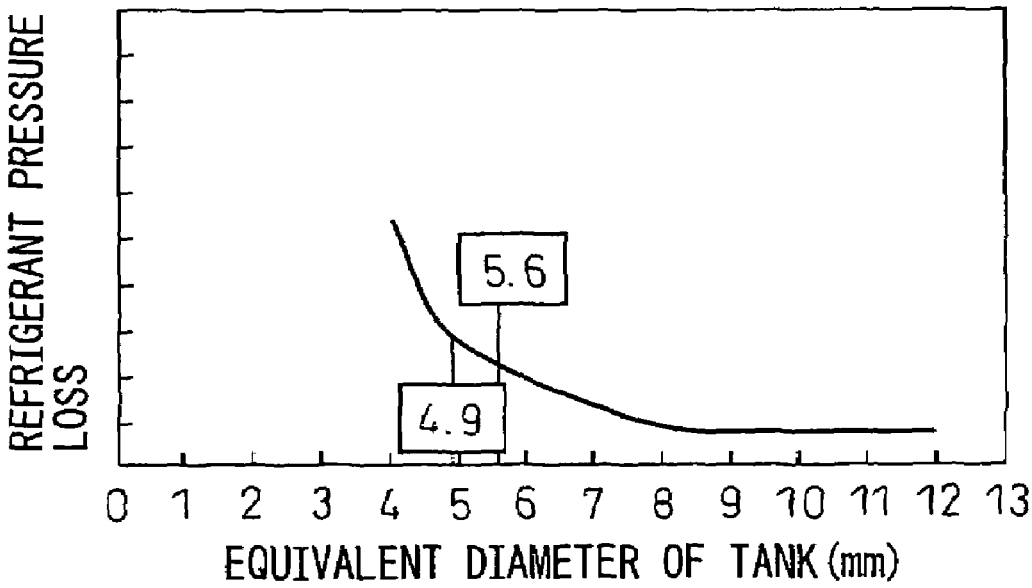

Further, the cooling performance and the pressure loss were studied using the test evaporator having three unit cores. As understood from FIGS. 11A, 11B showing the result, the equivalent diameter is required to be 4.7 mm to obtain the desired cooling performance, and 4.9 mm for the pressure loss of 0.3 MPa and 5.6 mm for the pressure loss of 0.2 MPa. In all cases, the equivalent diameter is increased slightly more than when two unit cores are involved.

According to the first best mode shown in FIGS. 1 to 4, the downstream-side core row 10 and the upstream-side core row 30 each include two unit cores 150 mm wide and 200 mm tall. Taking the result shown in FIGS. 7, 10A, 10B into consideration, therefore, the equivalent diameter was determined at 6 mm for all of the supply paths 25, 29 and the discharge paths 26, 28 of the upper tank 20. The same applies for the supply paths and the discharge paths of the lower tank 40.

(Operation)

As shown in FIG. 4, the refrigerant flows into the evaporator from the supply path 25 of the tank 14 downstream of the upper tank 20 in the downstream-side core row 10, and flows down in the tube group 12 of the left unit core 11. In the presence of the separator 24, no refrigerant flows in the discharge path 26. The refrigerant flows into the supply path of the tank 19 of the right unit core 16 from the discharge path of the tank 15 of the left unit core 11 at the lower end of the tube group 12, and moves up in the tube group 17.

After that, the refrigerant flows to the supply path 38 of the tank 29 of the right unit core 36 of the upstream-side core row 30 from the discharge path 26 of the tank 18 of the right unit core 16, and flows down in the tube group 37. Then, the refrigerant flows to the supply path of the tank 31 of the left unit core 31 from the discharge path of the tank 39 of the right unit core 36, and moving up in the tube group 32, is discharged from the discharge path 33 of the tank 28.

In this way, the refrigerant flows down through the left unit core 11 of the downstream-side core row 10, moves up through the right unit core 16, flows down through the right unit core 36 of the upstream-side core row 30, and moves up through the left unit core 31, while at the same time exchanging heat between the refrigerant and the air flowing downstream.

(Effects)

In the evaporator with the downstream-side core row 10 including two unit cores 11, 16 and the upstream-side core row 30 including two unit cores 31, 36, the equivalent diameter of the supply path 25 and the discharge path 26 of the upper tank 20 and the equivalent diameter of the discharge path 28 and the supply path 29 are determined at 6 mm. This is also the case with the lower tank 40. As a result, the following effects are obtained.

First, the variation in temperature distribution along the width of the downstream-side core row 10 and the upstream-side core row 30 is small, so that a cool air having a small difference is produced at both the driver's seat and the front passenger's seat. Specifically, as understood from FIG. 7, the variation in temperature distribution in the left unit core 11 and the right unit core 16 of the downstream-side core 10 is not more than several ° C. This is also the case with the upstream-side core 30.

Secondly, the pressure loss of the refrigerant is small in the tubes 12, 17 of the downstream-side core row 10, the supply path 25 of the tank 14, the discharge path 26 of the tank 18, the discharge path of the tank 15 and the supply path of the tank 16. This is also the case with the upstream-side core row 30. Specifically, as understood from FIGS. 10A to 11B, the pressure difference between the evaporator inlet (supply path 25) and the evaporator outlet (discharge path 28) is 0.2 MPa or thereabouts. As the operating pressure of the evaporator is not decreased much, the refrigeration cycle can be operated in an almost ideal state shown in FIG. 8A. As a result, the temperature increase of the compressor C and the radiator D is prevented, thereby obviating the problem of the shortage of strength without increasing the thickness.

The equivalent diameter of the discharge path 28 of the upper tank 20 is considered to have the tendency of having a greater effect than that of the supply path 25 on the pressure loss of the refrigerant. In FIG. 8C, consider that x corresponds to the supply path 25 shown in FIG. 4, y to the tubes 12, 17, 32, 37, and z to the discharge path 25. The pressure loss in z increases the evaporation temperature in y, and z is larger than x in refrigerant dryness degree. Thus, a larger volume leads to a correspondingly larger pressure loss.

<Modification of First Best Mode>

Figure 12:
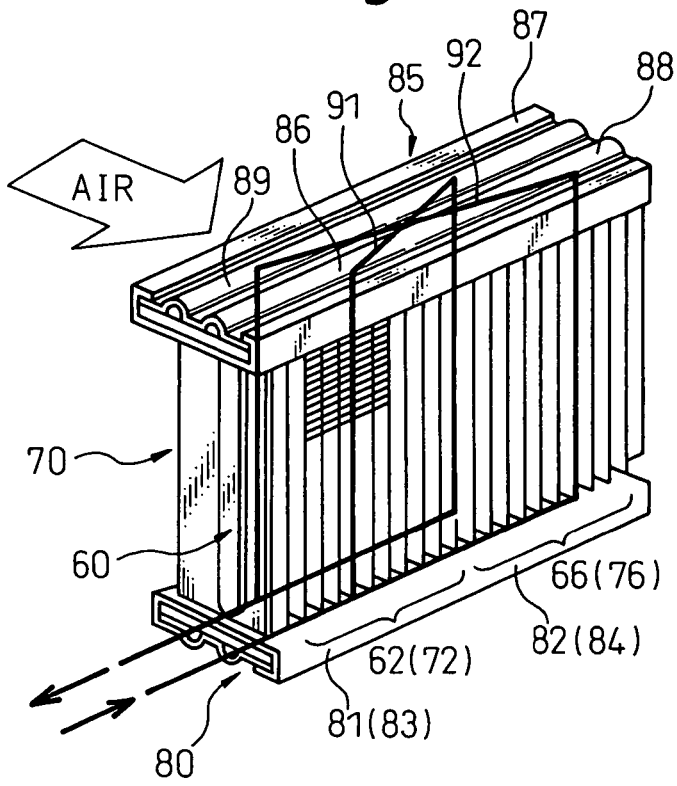
FIG. 12 is a perspective view showing a modification of the first best mode for carrying out the invention.

In the evaporator shown in FIG. 12, the downstream-side core row 60 and the upstream-side core row 70 each include two unit cores. The refrigerant flows in different vertical directions in the tubes of the core rows and in different directions in the tanks. Specifically, the tubes of both the left unit core 62 and the right unit core 66 of the downstream-side core row 60 constitute an up path, while both the left unit core 72 and the right unit core 76 of the upstream-side core row 70 make up a down path. The lower tank 80 connected to the lower end of the left unit core 62 and the right unit core 66 has two supply paths 81, 82 on the downstream side thereof and the discharge paths 83, 84 on the upstream side thereof.

The upper tank 85 connected to the upper end of the downstream-side core row 60 and the upstream-side core row 70 has two supply paths 87, 89 and two discharge paths 86, 88. The discharge path 86 and the supply path 87 on the one hand and the discharge path 88 and the supply path 89 on the other hand are connected by a pair of paths 91, 92 extending in the shape of X. The path 92 connects the right unit core 66 of the downstream-side core row 60 to the left unit core 72 of the upstream-side core row 70, while the other path 91 connects the left unit core 62 of the downstream-side core row 60 to the right unit core 76 of the upstream-side core row 70. The equivalent diameter of the supply paths 81, 82 and the discharge paths 83, 84 of the lower tank 80 and the supply paths 87, 89 and the discharge paths 86, 88 of the upper tank 85 are set to 6 mm, respectively.

The refrigerant supplied from the supply path 81 of the lower tank 80 moves up through the left unit core 62 and the right unit core 66 of the downstream-side core row 60, and flows across each other in the shape of X through the upper tank 85. After that, the refrigerant flows down in the right unit core 76 and the left unit core 72 of the upstream-side core row 70, and is discharged from the discharge path 82 of the lower tank 80.

This modification, in addition to the effect similar to that of the first best mode, can produce a unique effect that the cooling capacity is not unbalanced in transverse direction even in the case where the air capacity is different in transverse direction in the downstream-side core row 60 and the upstream-side core row 70.

<Second Best Mode>

(Configuration)

Figure 13:
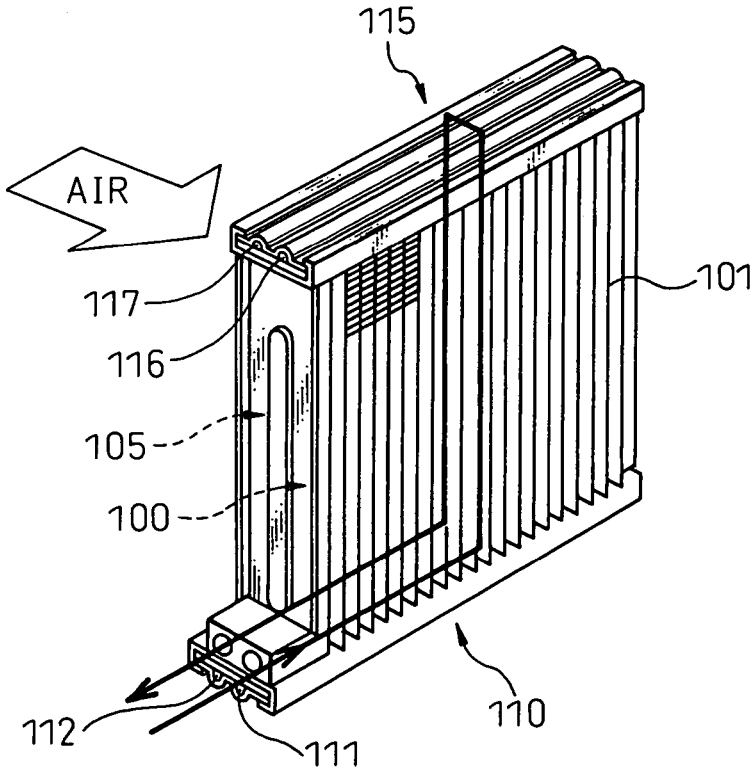
FIG. 13 is a perspective view showing the second best mode for carrying out the invention.

The evaporator according to the second best mode is shown in FIG. 13. In this evaporator, the refrigerant moves up through the whole downstream-side core 100 and flows down through the entire upstream-side core 105. In this connection, the lower tank 110 and the upper tank 115 have different configurations. Specifically, all the tubes 101 of the downstream-side core 100 constituted of a wide (307 mm wide) single unit core have a refrigerant up path, while all the tubes of the upstream-side core 105 constituted of a wide (307 mm wide) single unit core have a refrigerant down path.

The lower tank 110 arranged at the lower end of the downstream-side core 100 and the upstream-side core 105 has a supply path 111 and a discharge path 112. The supply path 111 is connected to the tubes of the downstream-side core 100, and the discharge path 112 to the tubes of the upstream-side core 105. No separator is arranged midway of the supply path 111 and the discharge path 112, and the refrigerant flows over the whole length. The upper tank 115 has a discharge path 116 connected to the upper end opening of the tubes 101 of the downstream-side core 100 and a supply path 117 connected to the upper end opening of the tubes of the upstream-side core 105. The height of the downstream-side core 100 and the upstream-side core 105 is 235 mm. The equivalent diameter of the supply path 111, the discharge path 112, the supply path 116 and the discharge path 117 is 6 mm.

In this evaporator, the refrigerant supplied to the supply path 111 of the lower tank 110 moves up in all the tubes 101 of the downstream-side core 100, and turns to the supply path 17 from the discharge path 116 of the upper tank 115. After that, the refrigerant flows down in all the tubes of the upstream-side core 105 and is discharged from the discharge path 112 of the lower tank 110.

(Method of Determining Equivalent Diameter)

a. Variation in Temperature Distribution

A first test evaporator (FIGS. 5A to 5D) is prepared which comprises a tube group about 307 mm wide, 235 mm tall and 38 mm thick, a tubular upper (inlet) tank connected to the upper end thereof and a tubular lower (outlet) tank mounted at the lower end thereof. The refrigerant flowing in from the inlet tank flows down in the tube group and flows out from the outlet tank. The refrigerant is 9.5 MPa in pressure and 30° C. in temperature at the inlet of the evaporator and 3.7 MPa in pressure and 1° C. in heating degree at the outlet of the evaporator, while the flow rate of the refrigerant is 50 kg/h. The air (wind), on the other hand, is 27° C. in temperature and 50% RH in humidity.

Figure 14:
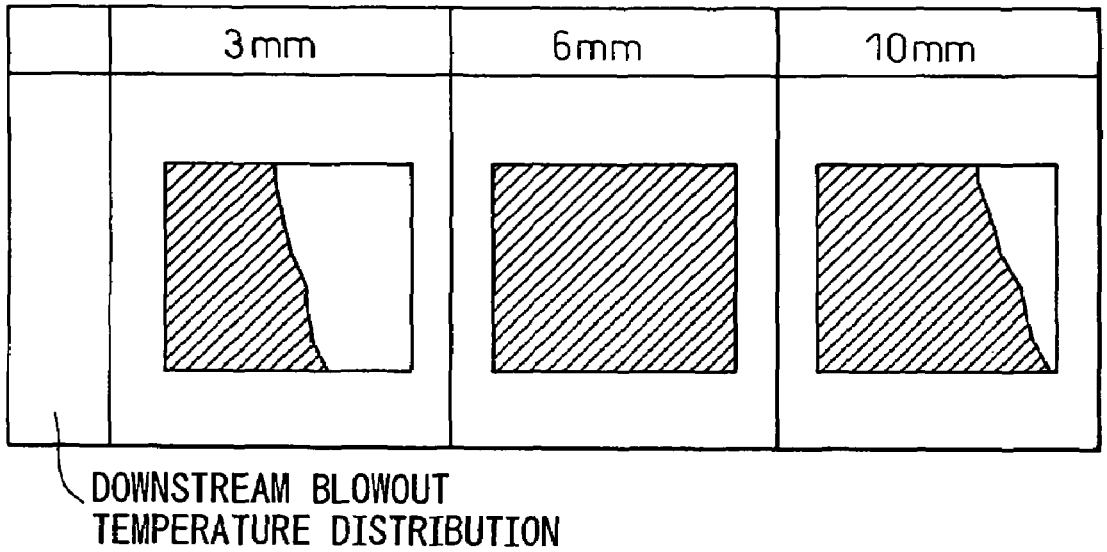
FIG. 14 is a diagram for explaining the manner in which the refrigerant flows for different equivalent diameters of the tank in the test evaporator.

The temperature distribution on the core surface with the equivalent diameter of the inlet and outlet tanks changed from 3 mm to 6 mm to 9 mm is shown in FIG. 14. As can be understood, the whole transverse portion of the core was kept at a low temperature for the equivalent diameter of 6 mm. For the equivalent diameter of 3 mm, on the other hand, the half portion near to the inlet (left end) was low in temperature, while the half portion far from the inlet was high temperature. Also, for the equivalent diameter of 9 mm, the portion farthest from the inlet was high in temperature, and the remaining portion was low in temperature.

Figure 15:
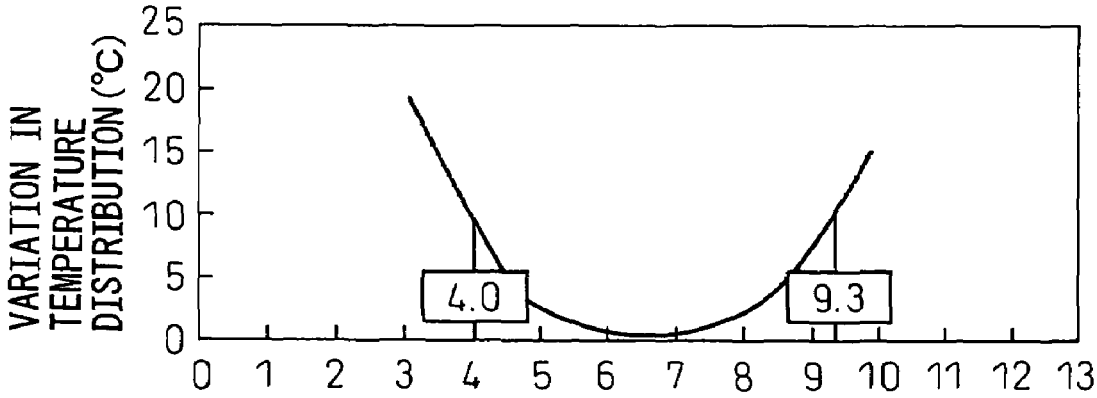
FIG. 15 is a graph showing the relation between the variation in temperature distribution and the equivalent diameter.

Using this test evaporator, the relation between the equivalent diameter of the inlet and outlet tanks and the variation in temperature distribution on the core surface, was studied. The result is shown in FIG. 15, from which it can be understood that the equivalent diameter associated with the difference of 10° C. between the maximum and minimum values of the average temperature of the various areas of the tube group is 4.0 to 9.3 mm.

b. Cooling Performance and Pressure Loss

Figure 16A:
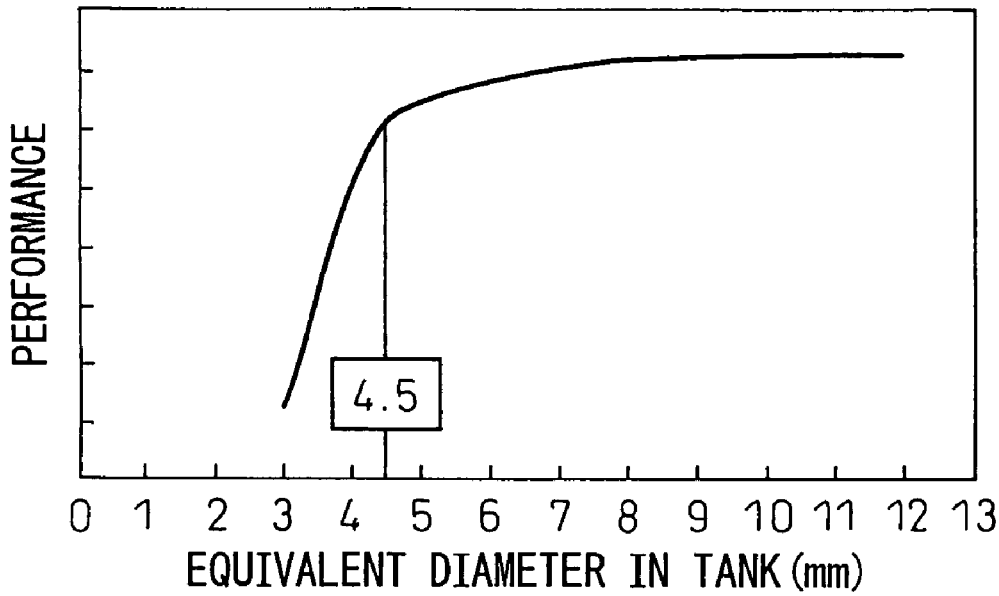
FIG. 16A is a graph showing the cooling performance of the core row including one unit core, and FIG. 16B a graph showing the pressure loss of the refrigerant.
Figure 16B:
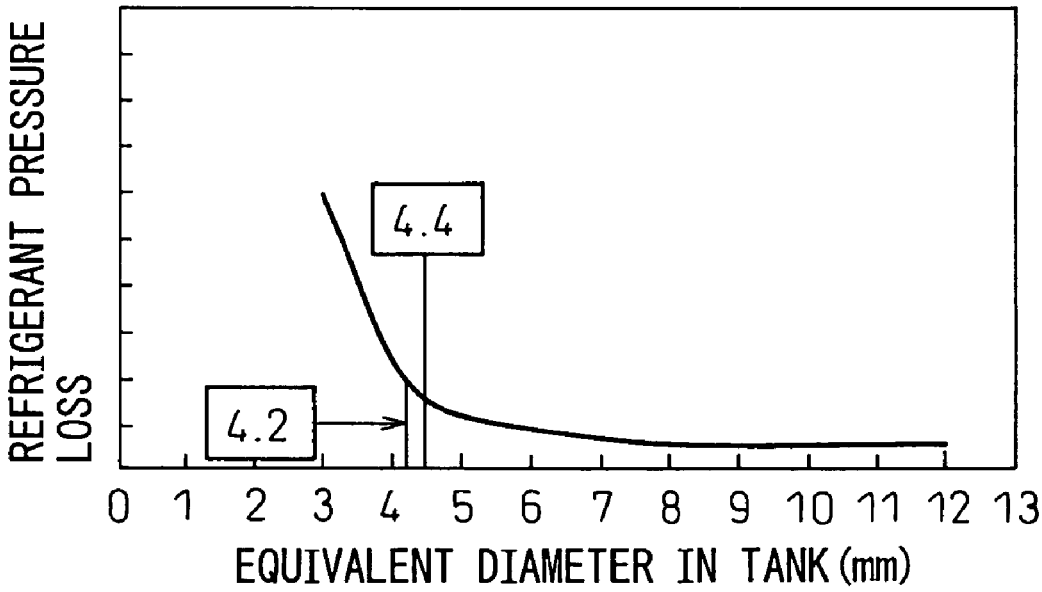

Using the test evaporator described above, the relation between the equivalent diameter of the inlet and outlet tanks and the cooling performance of the evaporator and the pressure loss of the refrigerant were studied. The result is shown in FIG. 16A, from which it can be understood that the cooling performance sharply increases for the equivalent diameter of 3 mm to 4.5 mm of the inlet and outlet tanks, and gradually increases for 4.5 mm to 7.0 mm, after which the cooling performance is not substantially increased. Also, as understood from FIG. 16B, the pressure loss of the refrigerant sharply decreases from 0.6 MPa to 0.2 MPa for the equivalent diameter of 3 mm to 4.2 mm of the inlet and outlet tanks, and gradually decreases for 4.2 mm to 4.5 mm, after which it gently decreases.

In addition, the cooling performance and the pressure loss were studied similarly using a second test evaporator including a tube group about 234 mm wide and inlet and outlet tanks 234 mm long and a third test evaporator including a tube group about 337 mm wide and inlet and outlet tanks 337 mm long. The result is shown in FIGS. 17A, 17B and 18A, 18B, respectively.

Figure 17A:
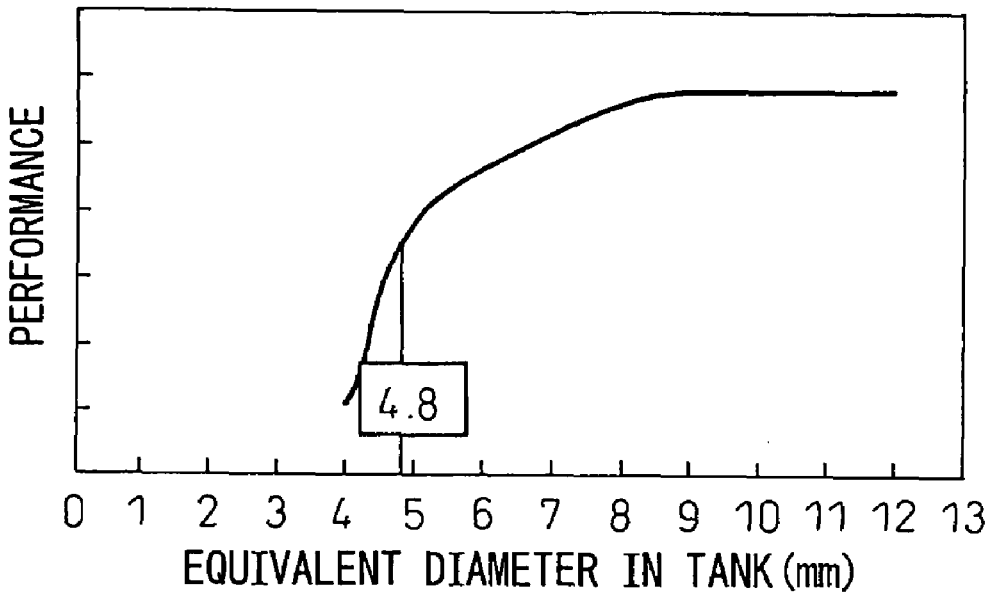
FIG. 17A is a graph showing the cooling performance of the core row including two unit cores, and FIG. 17B a graph showing the pressure loss of the refrigerant.
Figure 17B:
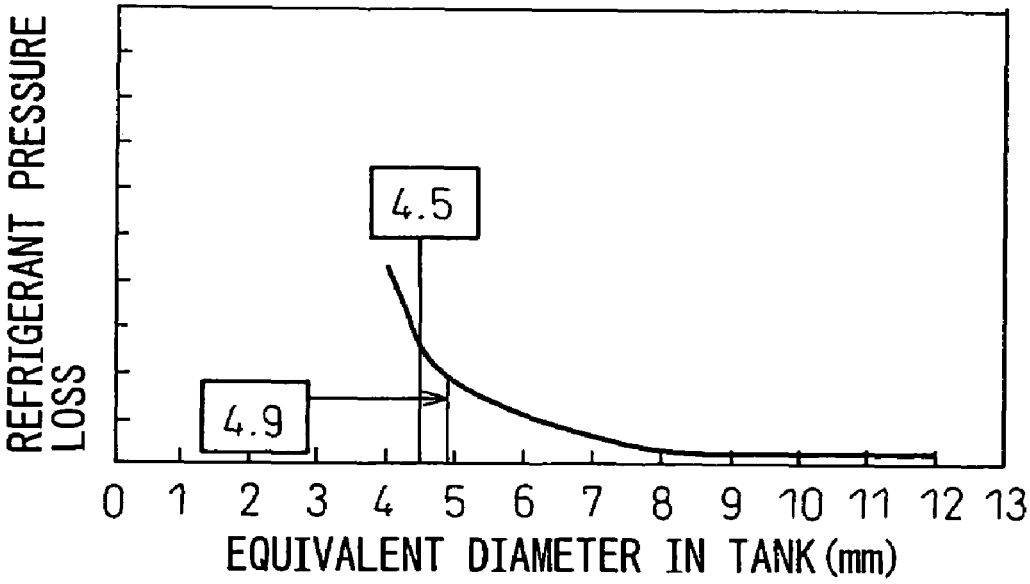
Figure 18A:
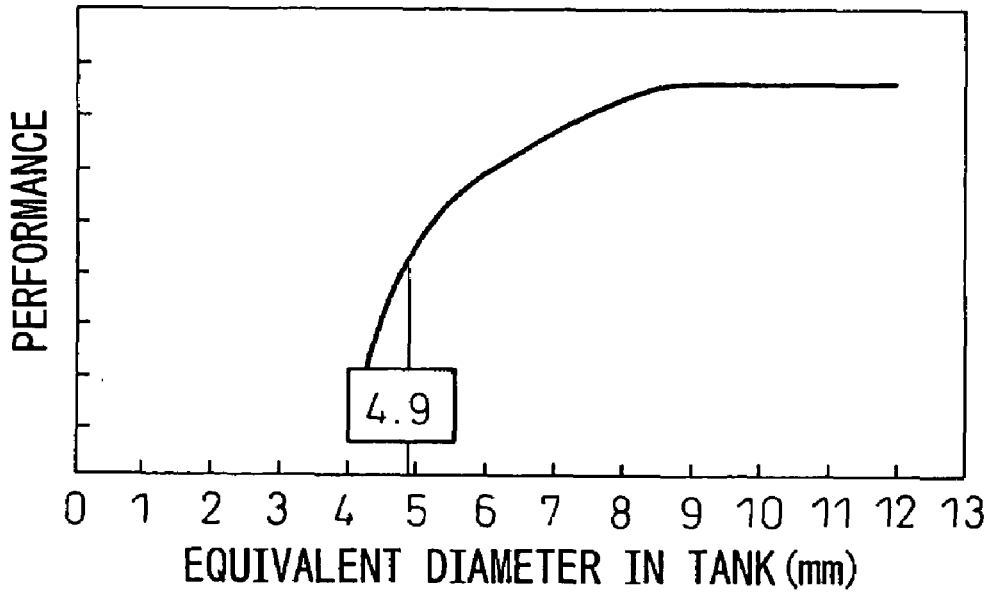
FIG. 18A is a graph showing the cooling performance of the core row including three unit cores, and FIG. 18B a graph showing the pressure loss of the refrigerant.
Figure 18B:
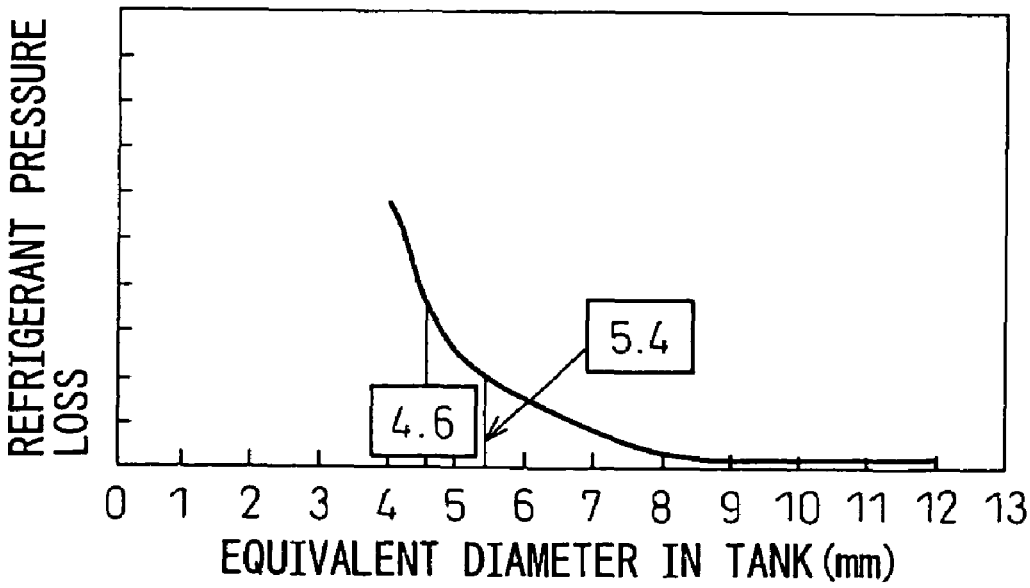

As understood from FIG. 17A, in the case of the second test evaporator, the lower limit of the equivalent diameter is 4.8 mm in respect of the cooling performance, and as understood from FIG. 17B, the lower limit of the equivalent diameter is 4.9 mm in respect of the pressure loss of the refrigerant. In the case of the third test evaporator, on the other hand, as understood from FIG. 18A, the lower limit of the equivalent diameter is 4.9 mm in respect to the cooling performance and, as understood from FIG. 18B, the lower limit of the equivalent diameter is 5.4 in respect of the pressure loss of the refrigerant. Through these experiments, the equivalent diameter of the supply path 111 and the discharge path 112 of the lower tank 110 according to the second best mode was determined at 6 mm. This is also the case with the discharge path 116 and the supply path 117 of the upper tank 115.

(Effects)

According to the second best mode, the evaporator with the downstream-side core 100 and the upstream-side core 105 each having a wide single unit core can produce the effects similar to those of the first embodiment. In addition, the tube group 101, etc., the lower tank 100 and the upper tank 105 are simple in structure and low in cost.

<Modification of Second Best Mode>

Figure 19:
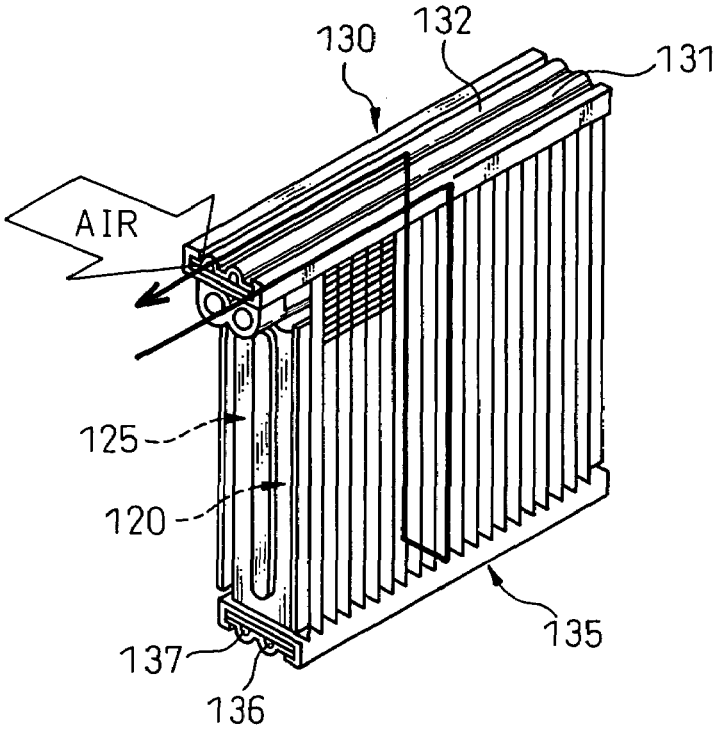
FIG. 19 is a perspective view showing a modification of the first best mode for carrying out the invention.

(A) The evaporator shown in FIG. 19, as compared with the second best mode described above, has a different direction of refrigerant flow. Specifically, an upper tank 130 is connected to the upper end and a lower tank 135 to the lower end of the tube group 121 of the downstream-side core 120 and the tube group of the upstream-side core 125. Therefore, all the tubes 121 of the downstream-side core 120 form a down path, and the refrigerant makes a U-turn at the lower tank 135, while all the tubes in the upstream-side core 125 form an up path. The upper tank 130 has a supply path 131 and a discharge path 132, while the lower tank 135 has a discharge path 136 and a supply path 137, of which the equivalent diameter is set to 6 mm. Incidentally, a control plate for controlling the refrigerant flow is desirably arranged in the path 131 making up the inlet side of the upper tank 130.

In this evaporator, the refrigerant supplied to the supply path 131 of the upper tank 130 flows down in the tubes 121 of the downstream-side core 120, and turns to the supply path 137 from the discharge path 136 of the lower tank 135. After that, the refrigerant moves up in the tubes of the upstream-side core 125 and flows out from the discharge path 132 of the upper tank 130. The provision of the control plate can suppress the separation of the refrigerant into a liquid refrigerant and a gas refrigerant.

Figure 20:
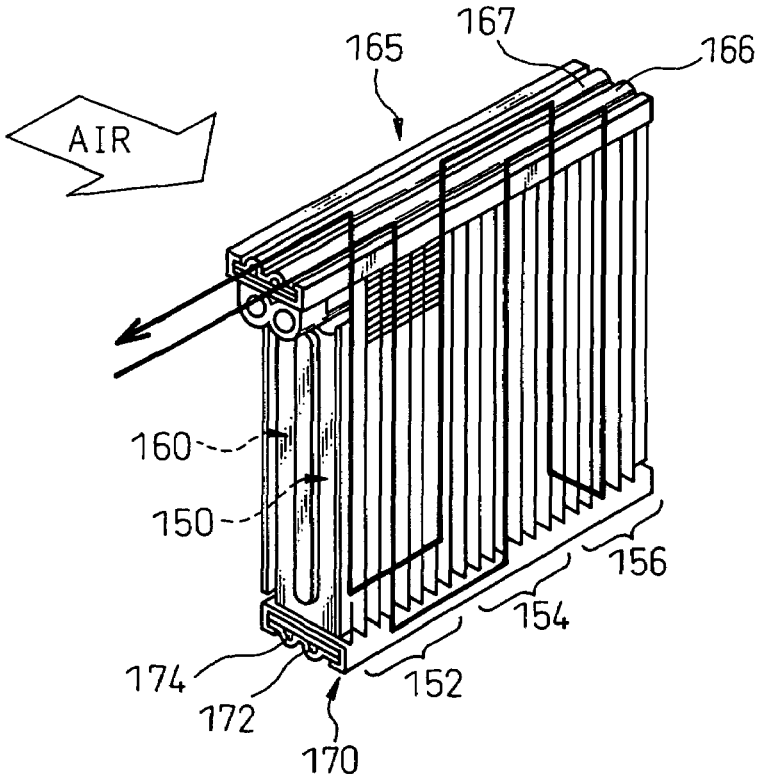
FIG. 20 is a perspective view showing another modification of the first best mode for carrying out the invention.

(B) In the evaporator shown in FIG. 20, the downstream-side core 150 and the upstream-side core 160 each include three unit cores. Specifically, the first unit core 152 on the left side of the downstream-side core 150 makes up a down path, the second unit core 154 at the intermediate portion an up path, and the third unit core 154 on the right side a down path. Similarly, the first unit core on the left side of the upstream-side core 160 makes up an up path, the second unit core at the intermediate portion a down path, and the third unit core on the right side an up path.

The path 166 downstream of the upper tank 165 connected to the upper end of the downstream-side core 150 and the upstream-side core 160 is divided into a left-end supply path, an intermediate discharge path and a right-end supply path by separators. This is also the case with the upstream-side path 168. Similarly, the path 172 downstream of the lower tank 170 is divided into a left-end supply path, an intermediate supply path and a right-end discharge path by separators. This is also the case with the upstream-side path 174. The equivalent diameter of the paths 166, 168, 172, 174 is 6 mm. The width of the downstream-side core row 150 and the upstream-side core row 160 is 280 mm, and the height thereof is 235 mm.

In this evaporator, the refrigerant flowing in from the left end of the path 166 downstream of the upper tank 165 flows down through the first unit core 152 of the downstream-side core 150, and through the path 172 downstream of the lower tank 170, moves up through the second unit core 154, after which the refrigerant flows down through the right-end third unit core 156 through the path 166 downstream of the upper tank 165. The refrigerant then flows to the path 174 upstream of the lower tank 170 from the path 172 downstream of the lower tank 170, moves up through the third unit core of the upstream-side core 160, flows down through the second unit core at the intermediate portion, and after moving up through the left-end first unit core, flows out from the path 168 upstream of the upper tank 165.

According to this modification, the provision of the three unit cores makes it possible to exchange heat with a large amount of air.

<Third Best Mode>

Figure 21:
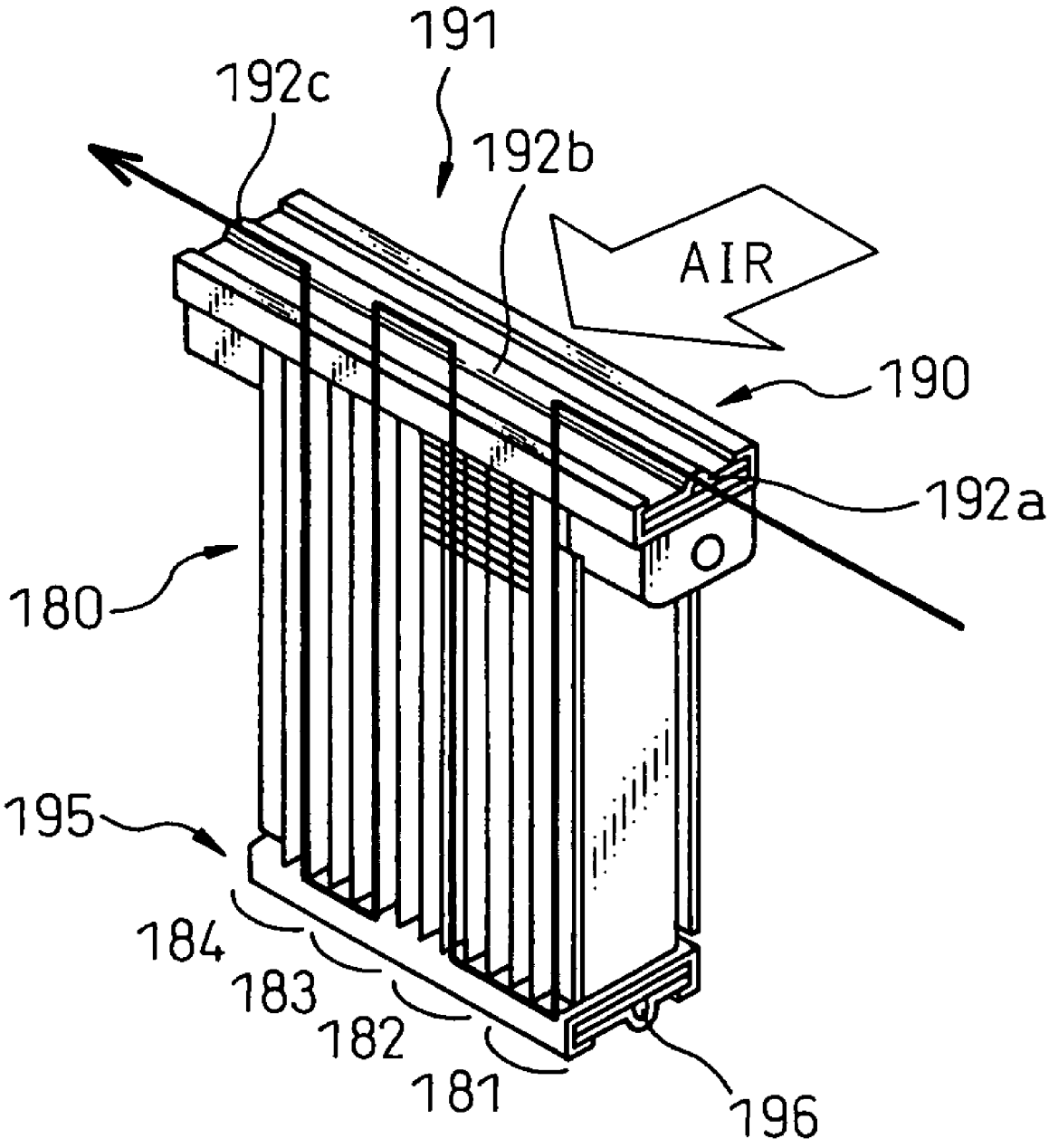
FIG. 21 is a perspective view showing the third best mode for carrying out the invention.

The evaporator according to the third best mode shown in FIG. 21 comprises a single core row 180 including four unit cores. Specifically, the cores 180 include four unit cores 181, 182, 183, 184. The tube group of the first unit core 181 makes up a down path, the tube group of the second unit core 182 an up path, the tube group of the third unit core 183 a down path, and the tube group of the fourth unit core 184 an up path. The upper tank 190 connected to the upper end of the tube group of the four unit cores has a linearly extending path 191 and is divided into a right-end supply path, an intermediate turn portion and a left-end discharge path by separators. On the other hand, the lower tank 195 connected to the lower end of the tube group of the four unit cores has a linearly extending path 196 and is divided into two turn portions by a separator. The equivalent diameter of the path 191 of the upper tank 190 and the path 196 of the lower tank 195 is set to 6 mm.

In this evaporator, the refrigerant flows down through the tube group of the first unit core 181 at the extreme right end, turns in transverse direction at the lower tank 195 and moves up through the tube group of the second unit core 182. Then, the refrigerant turns in transverse direction at the upper tank 190, flows down through the tube group of the third unit core 183, turns in transverse direction at the lower tank 195 and moves up through the tube group of the left-end fourth unit core 184.

According to this modification, in spite of a single row, there are four unit cores and therefore heat can be exchanged with larger amount of air.

<Modification of Tank and Tube>

Figure 22A:
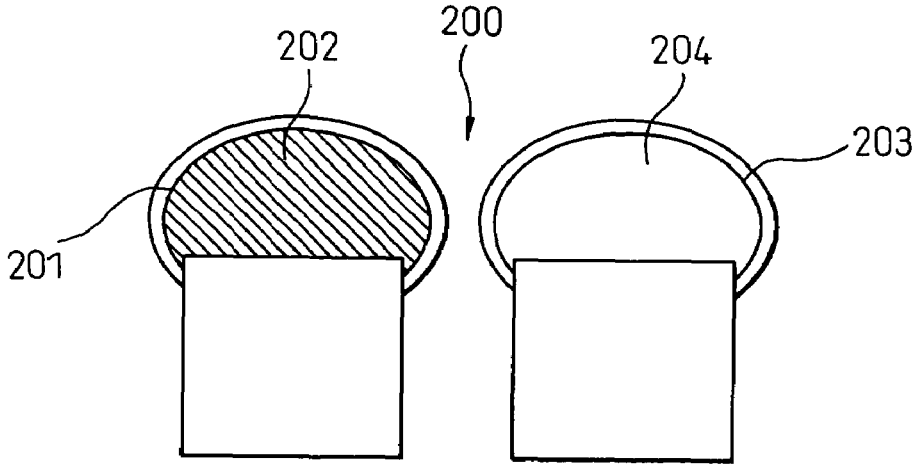
FIGS. 22A to 22C are diagrams for explaining modifications of connection between the core tubes and the first tank.
Figure 22B:
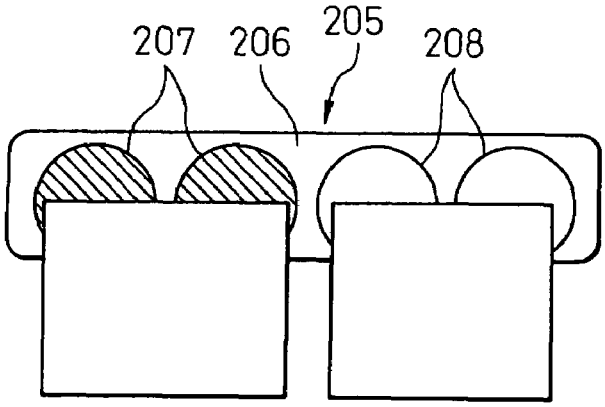
Figure 22C:
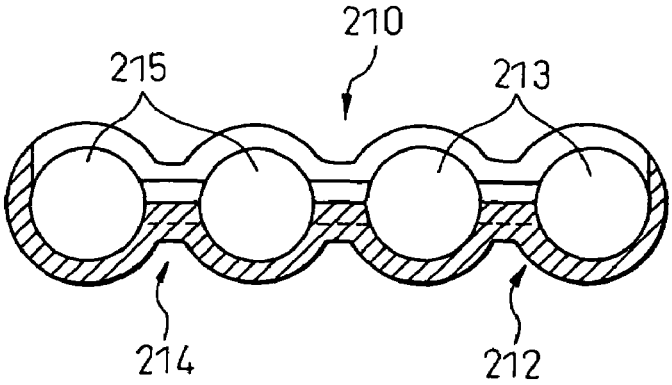

(A) The employed upper tank includes, as shown in FIG. 22A, an upper tank 200 including two pipes 201, 203 for defining the paths 202, 204 or an upper tank 200 formed with a pair of paths 207, 208 on one block member 206 as shown in FIG. 22B. Also, as shown in FIG. 22C, the downstream-side path 212 and the upstream-side path 214 of the upper tank 210 may each include two small paths 213, 215. In any case, the equivalent diameter of the paths 202, 204, the paths 207, 208 and the paths 212, 214 is set to 6 mm.

Figure 23A:
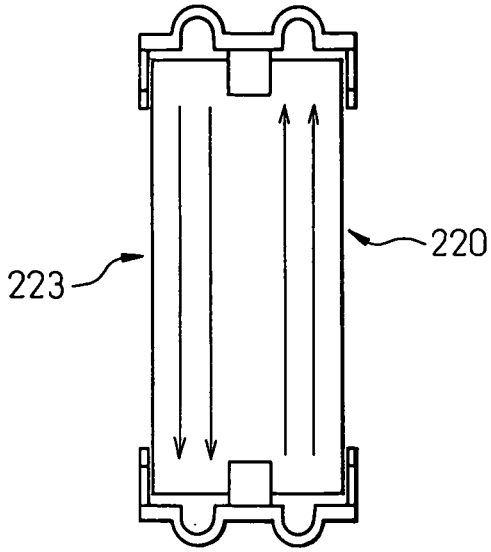
FIG. 23A is a sectional view showing a modification of the core tube, FIG. 23B a perspective view of the same, and FIG. 23C a plan view showing a groove between the tubes and the fin.
Figure 23B:
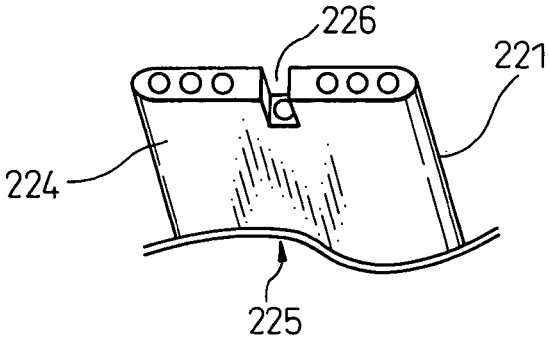
Figure 23C:
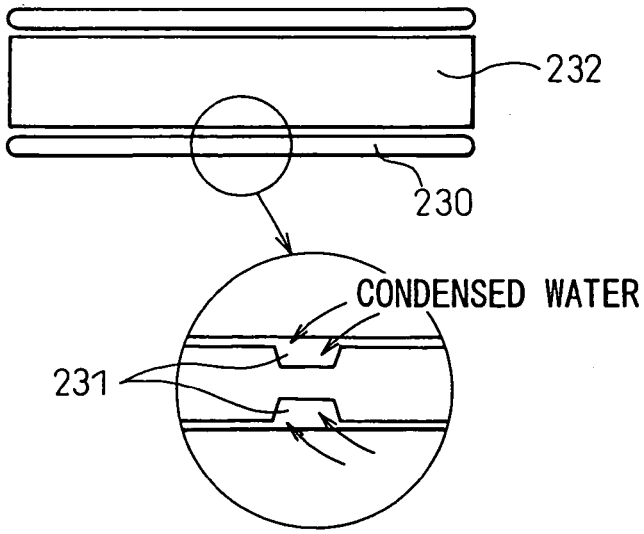
Figure 24A:
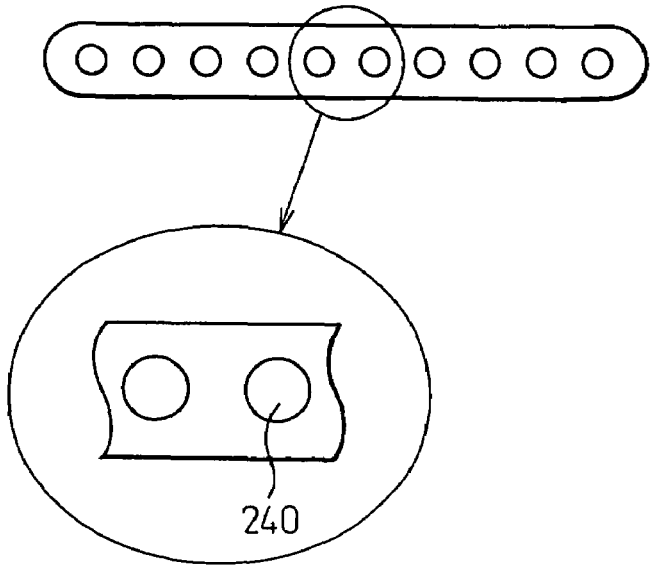
FIGS. 24A to 24C are sectional views showing a modification of the tubes.
Figure 24B:
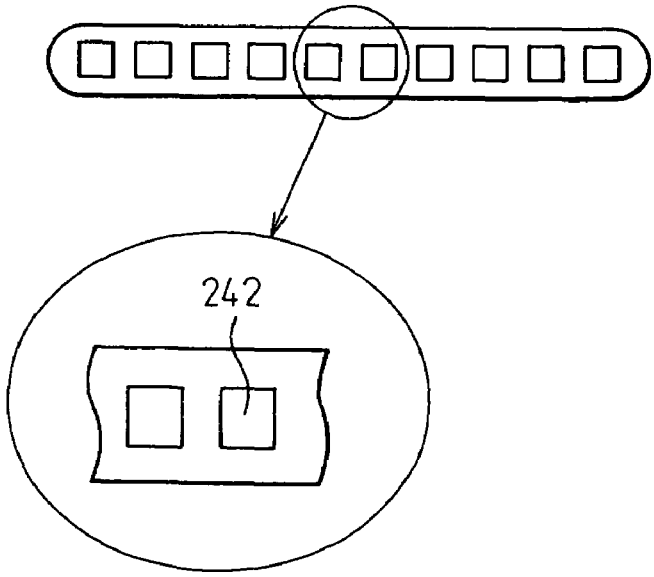
Figure 24C:
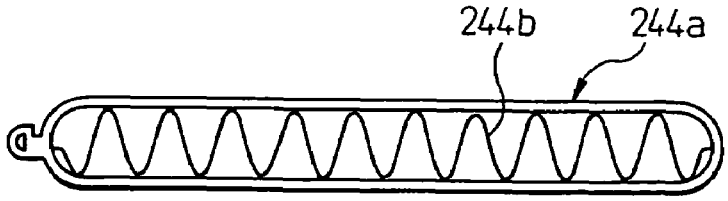

(B) As shown in FIGS. 23A, 22B, an integral tube 215 may be used which is integrally formed of the tubes 211 making up the downstream-side core 220 and the tubes 224 making up the upstream-side core 223. The tube 221 forms an up path, the tube 224 a down path, and a depression 226 is formed in transversely intermediate portion between the tubes 221, 224. Also, as shown in FIG. 24C, the condensed water attached on the surface of the tubes 230 can be positively discharged by forming a groove 231 extending along the height of the tube 230 on the surface of the tube 230 in contact with the fin 232.

A plurality of tubes making up the unit core are formed by the extrusion or drawing process. Through holes 240 having a square or rectangular cross section as shown in FIG. 24A or circular through holes 242 as shown in FIG. 24B may be employed. Also, as shown in FIG. 24C, the contour portion 244*a* and the internal heat transmission promoting portion 244*b* may be formed of a tabular member. In any case, the equivalent diameter of each through hole of the tubes is calculated at 0.08 mm not including the wetted perimeter.

Figure 25:
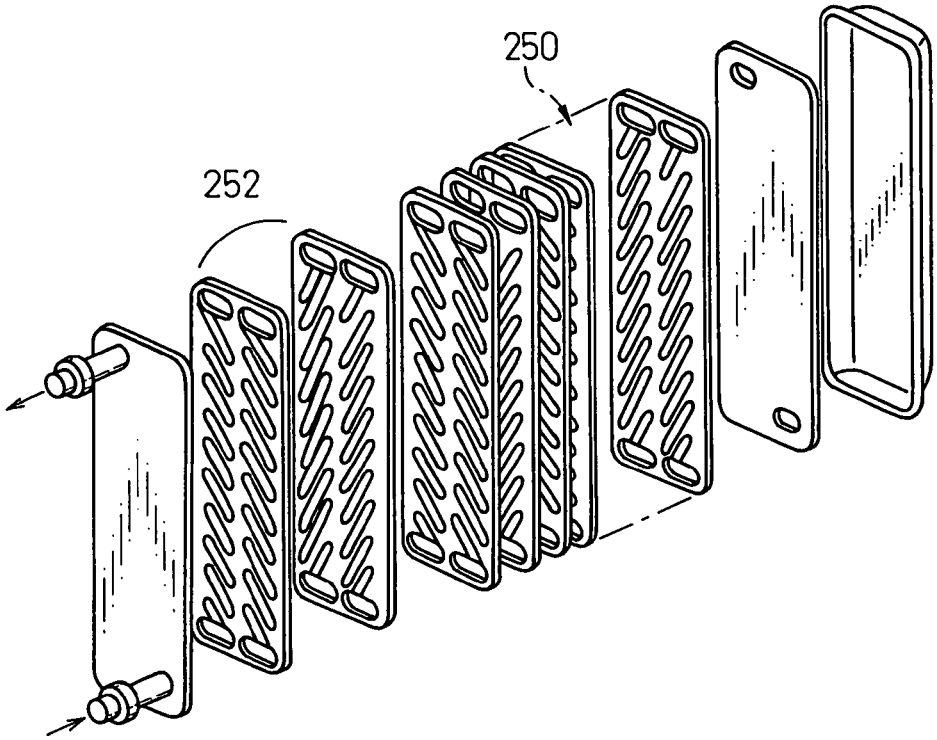
FIG. 25 is a perspective view showing another modification of the tubes.
Figure 26:
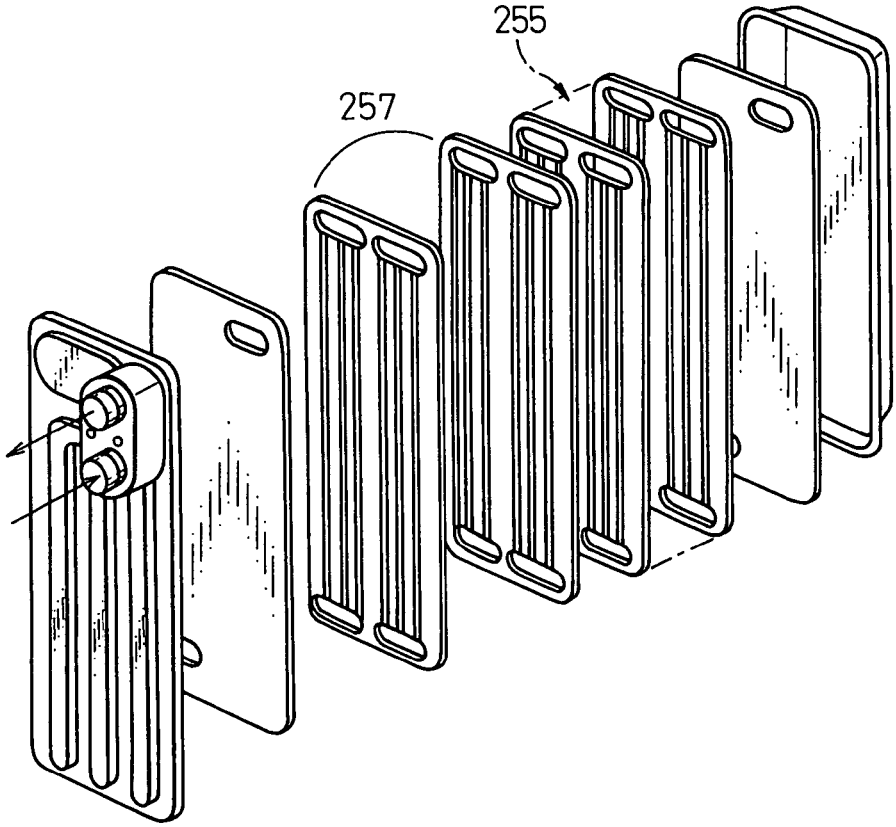
FIG. 26 is a perspective view showing still another modification of the tubes.

(C) FIG. 25 shows another modification of the tubes 250 and the tanks 252, and FIG. 26 still another modification of the tubes 255 and the tanks 257. In all of these modifications, the heat transmission tubes are formed of a plurality of stacked plates. In spite of the fact that the heat transmission tubes 250, 255 are entities independent of the tanks 252, 257, the same effects as in the aforementioned case are obtained. These effects are not substantially affected by the shape of the plate, and instead of the plate, an extrusion tube may be employed.

Although this invention has been described above based on specified embodiments, it is apparent to those skilled in the art that the invention can be altered or corrected variously without departing from the scope and spirit of thereof.

The invention claimed is:

1. An evaporator, operated with carbon dioxide gas, comprising at least a unit core including a plurality of heat transmission tubes having a path with a refrigerant flowing therein, a first tank connected to an end opening of the heat transmission tubes and formed with a refrigerant supply path and a second tank connected to the other end opening of the heat transmission tubes and formed with a refrigerant discharge path;

wherein the width L1 of the unit core is given as 50 mm≦L1≦175 mm;

wherein the equivalent diameter d of the refrigerant supply path of the first tank and the refrigerant discharge path of the second tank is given as 4.7 mm≦d≦9.6 mm.

2. An evaporator according to claim 1, wherein the equivalent diameter d of the refrigerant supply path and the refrigerant discharge path is given as 4.7 mm≦d≦8.0 mm.

3. An evaporator according to claim 1, wherein the equivalent diameter Dp of each heat transmission tube of the unit core of each core row is given as 0.55 mm≦Dp≦1.0 mm.

4. An evaporator according to claim 1, wherein the height H of each core row is given as 100 mm≦H≦235 mm.

5. An evaporator according to claim 1, wherein the refrigerant supply path and the refrigerant discharge path each include a plurality of paths.

6. An evaporator according to claim 1, wherein the heat transmission tubes of the unit core of the first core row are integrally formed with the heat transmission tubes of the unit core of the second core row.

7. An evaporator according to claim 6, wherein a fin is interposed between the adjacent heat transmission tubes of the unit core, and a groove extending along the height is formed on the surface of the heat transmission tubes in contact with the fin.

8. An evaporator according to claim 1, applicable to a refrigeration cycle having an internal heat exchanger.

9. An evaporator according to claim 1, applicable to an ejector cycle including an ejector.

10. An evaporator according to claim 1, applicable to a refrigeration cycle or an ejector cycle with an expansion valve or a gas-liquid separator arranged upstream of the evaporator.

11. An evaporator according to claim 1, applicable to a refrigeration cycle or an ejector with a gas-liquid separator arranged downstream of the evaporator.

12. An evaporator operated with carbon dioxide gas, comprising a core row including a plurality of transversely arranged unit cores each having a plurality of heat transmission tubes formed with a path in which the refrigerant flows, and a first tank connected to one end opening of the heat transmission tubes and formed with a refrigerant supply path and a second tank connected to the other end opening of the heat transmission tubes and formed with a refrigerant discharge path;

wherein the width L1 of each unit core is given as 50 mm≦L1≦175 mm; and wherein the equivalent diameter d of the refrigerant supply path of the first tank and the refrigerant discharge path of the second tank of each unit core are given as 4.7 mm≦d≦9.6 mm.

13. An evaporator according to claim 12, wherein the heat transmission tubes of the first unit core on one transverse side have a refrigerant up path or a refrigerant down path, and the heat transmission tubes of the second unit core on the other transverse side have a refrigerant down path or a refrigerant up path.

14. An evaporator according to claim 12, wherein the heat transmission tubes of the first unit core on one transverse side and the second unit core on the other transverse side both have a refrigerant up path and a refrigerant down path.

15. An evaporator according to claim 12, wherein the heat transmission tubes of the first unit core on one transverse side and the third unit core on the other transverse side have a refrigerant up path or a refrigerant down path and the heat transmission tubes of the second unit core have a refrigerant down path or a refrigerant up path.

16. An evaporator according to claim 12, wherein the heat transmission tubes of both the first unit core on one transverse side and the third unit core have a refrigerant up path or a refrigerant down path, and the heat transmission tubes of both the second unit core and the fourth unit core on the other transverse side have a refrigerant down path or a refrigerant up path.

17. An evaporator operated with the carbon dioxide gas, comprising a plurality of core rows arranged along the height with at least one transversely arranged unit core including a plurality of heat transmission tubes formed with a path in which the refrigerant flows, a first tank connected to one end opening of the heat transmission tubes and formed with a refrigerant supply path and a second tank connected to the other end opening of the heat transmission tubes and formed with a refrigerant discharge path;

wherein the width L1 of the unit core of each core row is given as 50 mm≦L1≦175 mm; and wherein the equivalent diameter d of the refrigerant supply path of the first tank and the refrigerant discharge path of the second tank of the unit core of each core row is given as 4.7 mm≦d≦9.6 mm.

18. An evaporator according to claim 17, wherein the first core row and the second core row are arranged in opposed relation to each other in the direction of air flow.

19. An evaporator according to claim 17, wherein the first core row, the second core row and the third core row are arranged in opposed relation to each other in the direction of air flow.

20. An evaporator according to claim 17, wherein the equivalent diameter d of the refrigerant supply path of the first tank and the refrigerant discharge path of the second tank of each core row is given as 4.9 mm≦d≦9.6 mm.

21. An evaporator according to claim 18, wherein the heat transmission tubes of the first unit core on one transverse side of the first core row have a refrigerant up path or a refrigerant down path, the heat transmission tubes of the second unit core on the other transverse side of the first core row have a refrigerant down path or a refrigerant up path, the heat transmission tubes of the first unit core on one transverse side of the second core row have a refrigerant down path or a refrigerant up path, and the heat transmission tubes of the second unit core on the other transverse side of the second core row have a refrigerant up path or a refrigerant down path, and wherein the width L2 of the first and second core rows is given as 100 mm≦L2≦350 mm.

22. An evaporator according to claim 21, wherein the equivalent diameter d of the refrigerant supply path and the refrigerant discharge path is given as 5.6 mm≦d≦9.6 mm, and wherein the width L2 of the first core row and the second core row is given as 200 mm≦L2≦350 mm.

23. An evaporator according to claim 19, wherein the heat transmission tubes of any one of the first, second and third unit cores of the first core row have a refrigerant up path or a refrigerant down path, and the remaining two heat transmission tubes have a refrigerant down path or a refrigerant up path, while the heat transmission tubes of any one of the first, second and third unit cores of the second core row have a refrigerant down path or a refrigerant up path, and the remaining two heat transmission tubes have a refrigerant up path or a refrigerant down path, and wherein the width L2 of the first and second core rows is given as 150 mm≦L2≦525 mm.

24. An evaporator according to any one of claim 18, wherein all the heat transmission tubes of at least two unit cores of the first core row have a refrigerant up path or a refrigerant down path, wherein all the heat transmission tubes of at least two unit cores of the second core row have a refrigerant down path or a refrigerant up path, and wherein the width L2 of the first and second core rows is given as 50 mm×(number of unit cores)≦L2≦175 mm×(number of unit cores).

25. An evaporator according to claim 24, wherein the second tank of the first unit core on one transverse side of the first core row is connected to the first tank of the second unit core on the other axial side of the second core row, and the second tank of the second unit core on the other axial side of the first core row is connected to the first tank of the first unit core on one axial side of the second core row.

26. An evaporator according to claim 24, wherein the first unit core of the first core row is connected with the first unit core of the second core row, and the second unit core of the first core row is connected with the second unit core of the second core row.

27. An evaporator according to claim 24, wherein the first and second unit cores of the first core row are connected with the first and second unit cores of the second core row.

28. An evaporator operated with the carbon dioxide gas, comprising a plurality of core rows juxtaposed in the direction along the thickness and including at least one transversely arranged unit core having a plurality of heat transmission tubes formed with a path in which the refrigerant flows, a first tank connected to one end opening of the heat transmission tubes and formed with a refrigerant supply path and a second tank connected to the other end opening of the heat transmission tubes and formed with a refrigerant discharge path;

wherein the width L1 of the unit core of each core row is given as 50 mm≦L1≦175 mm; and wherein the equivalent diameter d of the refrigerant supply path of the first tank and the refrigerant discharge path of the second tank of the unit core including the heat transmission tubes formed with a refrigerant down path are given as 4.7 mm≦d≦10.6 mm.

29. An evaporator according to claim 28, wherein the first and second core rows are arranged in an opposed relation to each other along the direction of air flow.

30. An evaporator according to claim 28, wherein the equivalent diameter d of the refrigerant supply path of the first tank and the refrigerant discharge path of the second tank of the unit core of each core row is given as 4.9 mm≦d≦9.6 mm.

31. An evaporator according to claim 28, wherein the heat transmission tubes of the first unit core on one transverse side of the first core row have a refrigerant up path or a refrigerant down path, and the heat transmission tubes of the second unit core on the other transverse side have a refrigerant up path or a refrigerant down path, wherein the heat transmission tubes of the first unit core on one transverse side of the second core row have a refrigerant up path or a refrigerant down path, and the heat transmission tubes of the second unit core on the other transverse side have a refrigerant down path or a refrigerant up path, and wherein the width L2 of the first and second core rows are given as 100 mm≦L2≦350 mm.

32. An evaporator according to claim 28, wherein the heat transmission tubes of one of the first, second and third unit cores of the upstream-side first core row have a refrigerant up path or a refrigerant down path, and the heat transmission tubes of the remaining two unit cores have a refrigerant down path or a refrigerant up path, wherein the heat transmission tubes of one of the first, second and third unit cores of the downstream-side second core row have a refrigerant down path or a refrigerant up path, and the heat transmission tubes of the remaining two unit cores have a refrigerant up path or a refrigerant down path, and wherein the width L2 of the first and second core rows is given as 150 mm≦L2≦425 mm.

33. An evaporator according to claim 28, wherein all the heat transmission tubes of two or more unit cores of the first core row have a refrigerant up path or a refrigerant down path, and the heat transmission tubes of two or more unit cores of the second core row have a refrigerant down path or a refrigerant up path, and wherein the width L2 of the first and second core rows is given as 50×(number of unit cores)≦L2≦175 mm×(number of unit cores).

34. An evaporator according to claim 31, wherein the equivalent diameter d of the refrigerant supply path and the refrigerant discharge path is given as 4.7 mm≦d≦8.0 mm.

35. An evaporator according to claim 31, wherein the equivalent diameter d of the refrigerant supply path and the refrigerant discharge path is given as 5.6 mm≦d≦9.6 mm, and the width L2 of the first and second core rows is given as 200 x≦L2≦350 mm.

36. An evaporator operated with the carbon dioxide gas, comprising at least two core rows juxtaposed in the direction along the thickness and each including at least two transversely arranged unit cores each having a plurality of heat transmission tubes formed with a path in which the refrigerant flows, a first tank connected to one end opening of the heat transmission tubes and formed with a refrigerant supply path for supplying the refrigerant to the heat transmission tubes and a second tank connected to the other end opening of the heat transmission tubes and formed with a refrigerant discharge path for discharging the refrigerant from the heat transmission tubes;

wherein the refrigerant discharged from the refrigerant discharge path of the second tank of the first unit core of the first core row is supplied to the refrigerant supply path of the first tank of the second unit core of the second core row in opposed relation to the second unit core of the first core row, and wherein the refrigerant discharged from the refrigerant discharge path of the second tank of the second unit core of the first core row is supplied to the refrigerant supply path of the first tank of the first unit core of the second core row in opposed relation to the first unit core of the first core row, wherein the width L1 of each unit core of each core row is given as 50 mm≦L1≦175 mm, and wherein the equivalent diameter d of the refrigerant supply path of the first tank and the refrigerant discharge path of the second tank of each unit core of each core row is given as 4.7 mm≦d≦9.6 mm.

37. An evaporator according to claim 36, wherein the equivalent diameter d of the refrigerant supply path and the refrigerant discharge path is given as 4.7 mm≦d≦8.0 mm.

38. An evaporator according to claim 36, wherein the equivalent diameter d of the refrigerant supply path of the first tank and the refrigerant discharge path of the second tank is given as 5.6 mm≦d≦9.6 mm, and the width L2 of the first and second core rows is given as 200 mm≦L2≦350 mm.

39. An evaporator operated with carbon dioxide gas, comprising at least on core row arranged in the direction along the thickness and each including at least one transversely arranged unit core having a plurality of heat transmission tubes formed with a path in which the refrigerant flows, a first tank connected to one end opening of the heat transmission tubes and formed with a refrigerant supply path for supplying the refrigerant to the heat transmission tubes and a second tank connected to the other end opening of the heat transmission tubes and formed with a refrigerant discharge path for discharging the refrigerant from the heat transmission tubes;

wherein all the heat transmission tubes of each core row have a refrigerant up path or a refrigerant down path, and the width L2 of each core row is given as 100 mm≦12≦350 mm; and wherein the equivalent diameter d of the refrigerant supply path of the first tank or the refrigerant discharge path of the second tank is given as 4.9 mm≦d≦10.6 mm.

40. An evaporator according to claim 39, comprising a upstream-side first core row including one unit core with the heat transmission tubes having a refrigerant up path and a downstream-side second core row including one unit core with the transmission tubes having a refrigerant down path and arranged in opposed relation to the unit core of the first core row in the direction along the thickness.

41. An evaporator according to claim 39, wherein a distribution control plate for adjusting the refrigerant distribution is arranged in the refrigerant supply path of the first tank.

* * * * *

UNITED STATES PATENT AND TRADEMARK OFFICE

CERTIFICATE OF CORRECTION

PATENT NO. : 7,347,064 B2
APPLICATION NO. : 11/316210
DATED : March 25, 2008
INVENTOR(S) : Yoshiki Katoh et al.

It is certified that error appears in the above-identified patent and that said Letters Patent is hereby corrected as shown below:

Col. 29, line 33, claim 39, “on” should be --one--

Col. 30, line 15, claim 39, “12” should be --L2--

Col. 30, line 21, claim 40, “a” should be --an--

Signed and Sealed this

Second Day of September, 2008

JON W. DUDAS
*Director of the United States Patent and Trademark Office*